US007745084B2

(12) United States Patent
Sugiura et al.

(10) Patent No.: US 7,745,084 B2
(45) Date of Patent: Jun. 29, 2010

(54) TONER, DEVELOPER INCLUDING THE TONER, AND IMAGE FORMING METHOD, IMAGE FORMING APPARATUS AND PROCESS CARTRIDGE USING THE TONER

(75) Inventors: Hideki Sugiura, Fuji (JP); Hitoshi Iwatsuki, Numazu (JP)

(73) Assignee: Ricoh Company Limited, Tokyo (JP)

( * ) Notice: Subject to any disclaimer, the term of this patent is extended or adjusted under 35 U.S.C. 154(b) by 941 days.

(21) Appl. No.: 11/185,803

(22) Filed: Jul. 21, 2005

(65) Prior Publication Data

US 2006/0024604 A1 Feb. 2, 2006

(30) Foreign Application Priority Data

Jul. 30, 2004 (JP) ..... 2004-223939

(51) Int. Cl.
*G03G 9/08* (2006.01)

(52) U.S. Cl. ..... 430/108.15; 430/110.1; 430/110.3; 430/110.4; 430/123.51; 399/159

(58) Field of Classification Search ..... 430/108.15, 430/110.1, 110.3, 110.4
See application file for complete search history.

(56) References Cited

U.S. PATENT DOCUMENTS 5,168,028 A * 12/1992 Nanya et al. ..... 430/108.15
5,429,901 A * 7/1995 Muto et al. ..... 430/108.11
6,284,424 B1 9/2001 Iimura et al.
7,056,638 B1 6/2006 Tomita et al.
7,074,541 B2 7/2006 Yamashita et al.
7,364,828 B2 4/2008 Yamashita et al.
2003/0152857 A1 8/2003 Sugiura et al.
2004/0067189 A1* 4/2004 Sugiura et al. ..... 423/335
2004/0115550 A1 6/2004 Sugiura et al.

(Continued)

FOREIGN PATENT DOCUMENTS

JP 11-52610 2/1999

(Continued)

OTHER PUBLICATIONS

Machine generated translation of JP 2003-207924, published Jul. 2003.*

(Continued)

*Primary Examiner*—Mark F Huff
*Assistant Examiner*—Peter L Vajda
(74) *Attorney, Agent, or Firm*—Oblon, Spivak, McClelland, Maier & Neustadt, L.L.P.

(57) ABSTRACT

A toner including a binder resin and a colorant, wherein a pellet of the toner which is prepared by applying a pressure of 15 kg/cm$^2$ to the toner has a tensile strength of from 900 Pa to 10,000 Pa, and wherein the toner has a methanol wettability of from 25 to 65% by volume, wherein the methanol wettability is measured by a method in which the toner is dispersed in a mixture solvent of water and methanol, and methanol is added to the toner dispersion while checking the transparency of the dispersion to determine a transparency fall starting point, wherein the methanol wettability is defined as {Vm/(Vm+Vw)}×100, wherein Vm represents a total volume (ml) of methanol in the dispersion at the transparency dropping point, and Vw represents the total volume of the pure water added.

20 Claims, 7 Drawing Sheets

U.S. PATENT DOCUMENTS

| | | | | |
|---|---|---|---|---|
| 2004/0136763 | A1* | 7/2004 | Murakami et al. | 399/350 |
| 2004/0185365 | A1* | 9/2004 | Saito et al. | 430/109.4 |
| 2004/0228648 | A1* | 11/2004 | Yanagida et al. | 399/100 |
| 2004/0229143 | A1 | 11/2004 | Umemura et al. | |
| 2005/0026061 | A1* | 2/2005 | Mikuriya et al. | 430/108.1 |
| 2005/0026064 | A1 | 2/2005 | Sugiura et al. | |
| 2005/0089787 | A1 | 4/2005 | Uchinokura et al. | |

FOREIGN PATENT DOCUMENTS

| | | | |
|---|---|---|---|
| JP | 11-133667 | | 5/1999 |
| JP | 2942588 | | 6/1999 |
| JP | 3102797 | | 8/2000 |
| JP | 2000-310882 | * | 11/2000 |
| JP | 2001-318485 | | 11/2001 |
| JP | 2003-50477 | | 2/2003 |
| JP | 2003-76056 | | 3/2003 |
| JP | 3407521 | | 3/2003 |
| JP | 2003-167369 | | 6/2003 |
| JP | 2003-202696 | | 7/2003 |
| JP | 2003-207924 | * | 7/2003 |
| JP | 2004-54139 | | 2/2004 |
| JP | 2004-145243 | | 5/2004 |
| JP | 2004-212540 | | 7/2004 |
| JP | 2004-212620 | | 7/2004 |
| JP | 2004-212819 | | 7/2004 |

OTHER PUBLICATIONS

English translation of JP 2000-310882 published Nov. 2000.*
U.S. Appl. No. 11/608,012, filed Dec. 7, 2006, Sugiura.
U.S. Appl. No. 11/608,521, filed Dec. 8, 2006, Satoru, et al.
U.S. Appl. No. 11/870,613, filed Oct. 11, 2007, Iwatsuki, et al.
U.S. Appl. No. 12/040,451, filed Feb. 29, 2008, Saitoh, et al.
U.S. Appl. No. 12/013,108, filed Jan. 11, 2008, Yagi, et al.

* cited by examiner

TONER, DEVELOPER INCLUDING THE TONER, AND IMAGE FORMING METHOD, IMAGE FORMING APPARATUS AND PROCESS CARTRIDGE USING THE TONER

BACKGROUND OF THE INVENTION

1. Field of the Invention

The present invention relates to a toner, a developer including the toner, and an image forming method, an image forming apparatus and a process cartridge using the toner.

2. Discussion of the Background

In image forming apparatus such as electrophotographic image forming apparatus and electrostatic recording apparatus, images are prepared by a method including the following processes:

(1) an electrostatic image is formed on an image bearing member such as photoreceptors and dielectric materials (electrostatic latent image forming process);
(2) the electrostatic image is developed with a developer including a charged toner to prepare a toner image on the image bearing member (developing process);
(3) the toner image is transferred to a receiving material optionally via an intermediate transfer medium (transfer process);
(4) the toner image is heated to fix the toner image on the receiving material (fixing process); and
(5) toner particles remaining on the surface of the image bearing member are removed therefrom such that the image bearing member is ready for the next image forming operation (cleaning process).

The toner for use in such an image forming method includes at least a binder resin and a colorant, and optionally includes a charge controlling agent, a release agent and other additives.

Recently a need exists for an electrophotographic image forming apparatus capable of producing high quality images, particularly, high quality full color images. Full color images produced by electrophotographic copiers are inferior to those produced by printing machines in image quality. Therefore, electrophotographic copiers are required to produce high definition images having as good image quality as those of photographs and prints. In attempting to produce high quality images, various toners have been proposed. In order to produce high quality images, the toner used therefor is required to have the following properties:

(1) a good developability so as to efficiently and faithfully develop an electrostatic latent image;
(2) a good transferability so as to be efficiently transferred to a receiving material;
(3) a good fixability so as to be fixed in a wide fixing temperature range without causing an offset problem; and
(4) a good cleanability so as to be well removed from an image bearing member by a cleaner.

For example, in order to impart good developability, transferability and cleanability of a toner, it is attempted to improve the charge properties of the toner. Specifically, it is described in Japanese Patents Nos. 2,942,588 and 3,102,797 that by using a toner including a specific fluorine-containing ammonium salt as a charge controlling agent, the charge properties of the toner can be improved. However, when such a fluorine-containing ammonium salt is used for a toner, there is a case where the fixability of the toner deteriorates (specifically, the fixable temperature range narrows) although the charge properties of the toner can be improved. In addition, it is described in Japanese Patent No. 3,407,521 that by localizing a fluorine-containing compound on the surface of toner particles while controlling the atomic ratio of fluorine atoms to carbon atoms on the surface of the toner particles, the charge properties of the toner can be improved. However, such a technique has a drawback in that the fixability of the toner deteriorates.

As for the fixability, it is described in published unexamined Japanese patent application No. (hereinafter referred to as JP-A) 11-133667 that by using a polyester resin modified so as to have a urea bonding as a binder resin, the high temperature preservability and low temperature fixability can be improved. However, as a result of the present inventors' study, it is found that by using only such a polyester resin, the charge stability to withstand various environmental conditions is hardly improved (namely, the charge of the toner considerably changes when temperature and humidity changes, for example, from normal temperature and humidity conditions to high (or low) temperature and high (or low) humidity conditions).

In addition, it has been described in JP-As 2003-076056 and 2003-167369 that by controlling the methanol wettability, which will be explained later in detail, of a toner so as to be from 35 to 60% by volume, the stability to withstand various environmental conditions and the charge quantity distribution of the toner can be improved. However, as a result of the present inventors' study, it is found that only by controlling the methanol wettability, good stability to withstand environmental conditions of the toner cannot be controlled. In this regard, good stability to withstand various environmental conditions means a good combination of charge and preservation stabilities to withstand various environmental conditions, and is hereinafter referred to as environmental stability. Namely, a toner having good environmental stability is such that even when the toner is preserved under high (or low) temperature and high (or low) humidity conditions, the toner can maintain good chargeability, transferability, fixability and cleanability while the toner particles hardly cause agglomeration.

Further, it is described in JP-A 2003-050477 that by controlling the tensile strength of a toner so as to be from 10 to 1400 $N/m^2$ when the toner is pressed at a pressure of 10 $kg/cm^2$, a good combination of developability and transferability can be imparted to the toner. However, as a result of the present inventors' study, it is found that only by controlling the tensile strength, there is a case where the developability and transferability of the toner cannot be fully improved.

Because of these reasons, a need exists for a toner having a good combination of developability, transferability, fixability, cleanability and environmental stability.

SUMMARY OF THE INVENTION

Accordingly, an object of the present invention is to provide a toner having a good combination of developability, transferability, fixability, cleanability and environmental stability.

Another object of the present invention is to provide a developer, an image forming method, an image forming apparatus and a process cartridge, by which high quality images having high image density, good evenness and good sharpness can be produced for a long period of time with hardly causing a background development problem and a toner scattering problem.

Briefly these objects and other objects of the present invention as hereinafter will become more readily apparent can be attained by a toner including at least a binder resin and a colorant, wherein the toner has a methanol wettability of from 25 to 65% by volume, and a pellet of the toner which is prepared by applying a pressure of 15 kg/cm$^2$ to the toner has a tensile strength of from 900 Pa to 10000 Pa. The methanol wettability is measured by the following method:

(1) 0.5 g of the toner is dispersed in a mixture solvent of 42 ml of pure water and 18 ml of methanol;

(2) the mixture is subjected to a dispersion treatment using an ultrasonic dispersion machine for 5 minutes to prepare a toner dispersion; and (3) methanol is added to the toner dispersion while the transparency of the dispersion is checked to determine a transparency dropping point.

The methanol wettability (MEW) is defined by the following equation:

$$MEW(\%\text{ by volume})=\{Vm/(Vm+Vw)\}\times 100$$

wherein Vm represents the total volume (ml) of methanol in the dispersion at the transparency dropping point, and Vw represents the total volume (i.e., 42 ml) of pure water added.

The binder resin preferably includes a polyester resin, and more preferably a combination of a modified polyester resin (MPE) and an unmodified polyester resin (UMPE). The weight ratio (MPE/UMPE) is preferably from 5/95 to 80/20 by weight.

The toner preferably includes a fluorine-containing compound, and more preferably, an ion having the following formula:

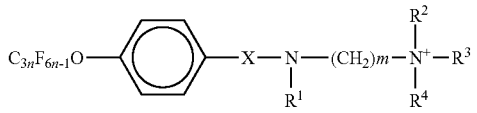

wherein X represents —$SO_2$— or —CO—; each of $R^1$, $R^2$, $R^3$ and $R^4$ represents a hydrogen atom, an alkyl group having from 1 to 10 carbon atoms, or an aryl group having from 6 to 18 carbon atoms; and each of m and n is a positive integer.

It is preferable that the atomic ratio (F/C) of fluorine atoms to carbon atoms at the surface of the toner is preferably from 0.010 to 0.110.

The ion of a fluorine-containing compound is preferably bonded with the surface of the polyester resin. This toner is preferably prepared by a method including the following steps:

reacting a toner composition including a polyester prepolymer with a crosslinking agent and/or a polymer chain extension agent in an aqueous medium to prepare a dispersion including a polyester resin; and adding a fluorine containing compound to the dispersion to adhere the fluorine-containing compound with the surface of the polyester resin, preferably to bond the ion of the compound with the surface of the polyester resin, wherein the ion includes a fluorine atom.

The toner preferably includes a hydrophobized particulate inorganic material having a primary particle diameter of from 30 to 150 nm, and more preferably a combination of a first hydrophobized particulate inorganic material having a primary particle diameter of from 30 to 150 nm and a second hydrophobized particulate inorganic material having a primary particle diameter of from 1 to 20 nm.

It is preferable that the toner has a circularity of from 0.90 to 0.99, and/or a combination of a first form factor SF-1 of from 103 to 150 and a second form factor SF-2 of from 101 to 140.

It is preferable that the toner has a volume average particle diameter of from 2 to 7 μm, and/or a ratio (Dv/Dn) of the volume average particle diameter (Dv) of the toner to the number average particle diameter (Dn) thereof is not greater than 1.15.

As another aspect of the present invention, a developer is provided which includes the toner mentioned above and a carrier.

As yet another aspect of the present invention, an image forming apparatus is provided, which includes:

an image bearing member configured to bear an electrostatic latent image thereon;

a developing device configured to develop the electrostatic latent image with a developer including the toner mentioned above to form a toner image on the image bearing member; and a transferring device configured to transfer the toner image onto a receiving material optionally via an intermediate transfer medium.

The image bearing member is preferably a photoreceptor including amorphous silicon. When an electrostatic latent image is formed, a contact charging device configured to apply a voltage to the photoreceptor while contacting the surface of the photoreceptor is preferably used. It is preferable that the image forming apparatus further includes a fixing device having a heating member including a heater, a film which contacts the heating member and heats the receiving material having the toner image thereon while contacting the image, and a pressing member configured to press the film toward the hearing member, wherein the receiving material is passed through a nip between the film and the pressing member.

As a further aspect of the present invention, a process cartridge is provided, which includes a unit including at least an image bearing member configured to bear an electrostatic latent image and a developing device configured to develop the latent image with a developer including the toner mentioned above.

As a still further aspect of the present invention, an image forming method is provided, which includes the following steps:

forming an electrostatic latent image on an image bearing member;

developing the electrostatic latent image with a developer including the toner mentioned above to prepare a toner image;

transferring the toner image onto a receiving material.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
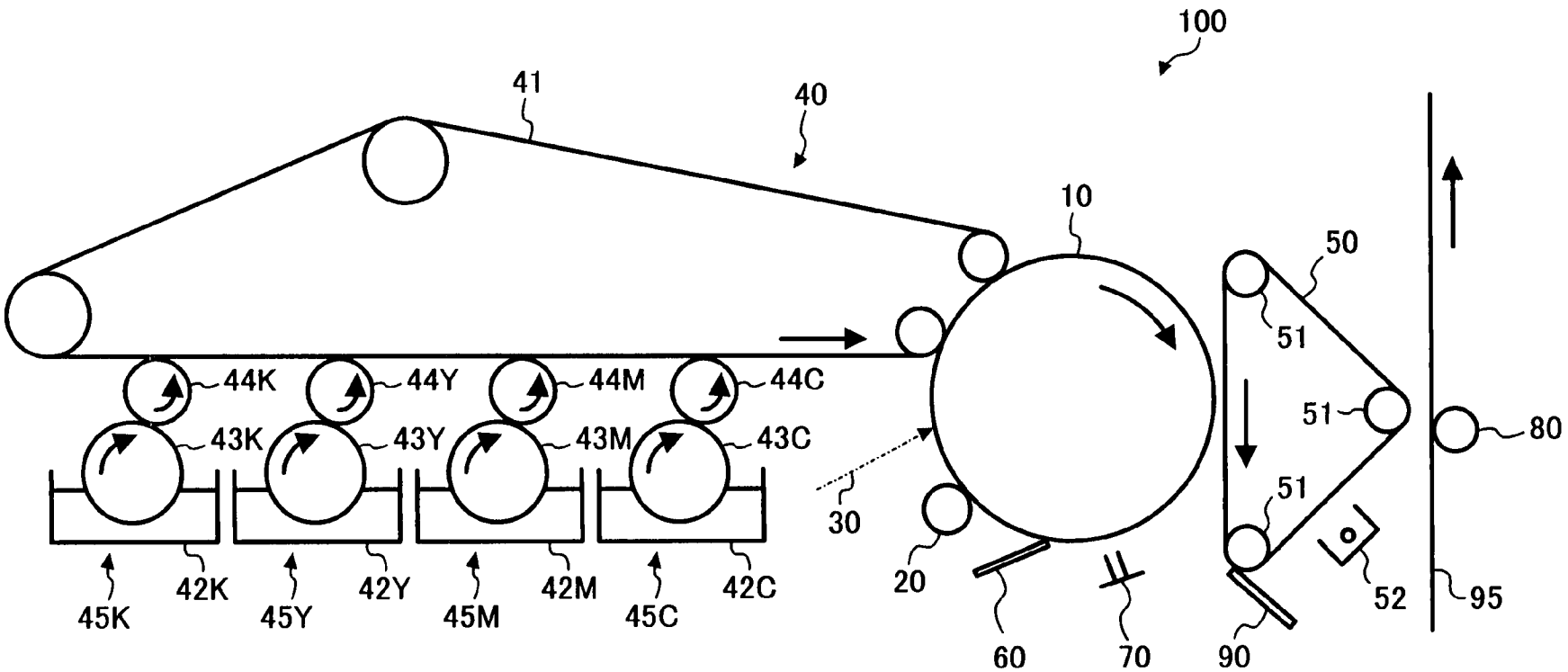
FIG. 1 is a schematic view illustrating an embodiment (i.e., a full color image forming apparatus) of the image forming apparatus of the present invention.

The toner of the present invention includes at least a binder resin and a colorant. The toner has a tensile strength of from 900 Pa to 10000 Pa when the tensile strength is determined by subjecting a pellet of the toner, which is prepared by pressing the toner at a pressure of 15 kg/cm$^2$, to a tensile strength test. In addition, the toner has a methanol wettability of from 25 to 65% by volume. Therefore, the toner has a good combination of developability, transferability, fixability, cleanability, and environmental stability (i.e., a combination of high charge stability to withstand various environmental conditions and good preservability)

In order to improve image qualities of electrophotographic full color images, it is effective to use a toner having a small particle diameter. However, when the particle diameter of a toner decreases, the transferability and fixability of the toner deteriorate, resulting in formation of color images having poor image qualities. The transferability and fixability of a toner greatly depend on the forces exerted between particles of the toner. Such inter-particle forces are classified into electrostatic adhesion forces and non-electrostatic adhesion forces. The non-electrostatic adhesion forces of a toner are classified into the van der Waals' force and the liquid-crosslinking force. The developability, transferability, fixability, cleanability and environmental stability of a toner are influenced not only by the electrostatic adhesion forces, but also by the non-electrostatic adhesion forces of the toner. In particular, when the particle diameter of a toner decreases, the above-mentioned properties are greatly influenced not only by the liquid-crosslinking force but also by the van der Waals' force of the toner.

The present inventors consider that when the van der Waals' force exerted to toner particles increases, a strong force has to be applied to separate adhered toner particles. Therefore, the present inventors consider that the tensile strength of pressed toner particles can be used as an alternative property of the van der Waals' force exerted to toner particles. Specifically, it is found that by measuring the tensile strength of a pellet of each of toners prepared by pressing the toner at a pressure of 15 kg/cm$^2$, the van der Waals' forces of the toners can be compared with each other.

When a toner has a strong liquid-crosslinking force, the toner has a high hydrophilic property. In contrast, when a toner has a weak liquid-crosslinking force, the toner has a high hydrophobicity. Therefore, the present-inventors consider that by measuring the hydrophobic property of toners, the liquid-crosslinking forces of the toners can be compared with each other. Specifically, it is found that by measuring the methanol wettability of toners, the liquid-crosslinking forces of the toners can be compared with each other.

Specifically, the present inventors discover that by controlling the tensile strength of a pellet of a toner, which is prepared by pressing the toner at a pressure of 15 kg/cm$^2$, so as to be from 900 Pa to 10000 Pa, the van der Waals' force of the toner can be properly controlled. In addition, by controlling the methanol wettability of a toner so as to be from 25 to 65% by volume, the liquid-crosslinking force of the toner can be properly controlled. Thus, the non-electrostatic adhesion forces of a toner can be controlled.

Thus, by controlling the non-electrostatic adhesion forces of a toner, a good combination of developability, transferability, fixability, cleanability and environmental stability can be imparted to the toner. In particular, the toner has a good combination of toner transferability, cleanability, charge stability to withstand various environmental conditions and high temperature preservability even after long repeated use (even after production of several tens of thousands of images).

In the developing process, toner particles are adhered to an electrostatic image formed on a photoreceptor due to electrostatic adhesion force of the toner. However, when the toner has strong non-electrostatic adhesion forces, the toner also adheres to non-image areas of a photoreceptor, resulting in occurrence of the background development problem. In addition, in a case of a two component developer, the toner also adheres to the carrier used, resulting in occurrence of the spent toner problem in that a film of the toner is formed on the surface of the carrier, and thereby the developability of the toner deteriorates. In a case of a one component developer, the toner adheres to the developing sleeve used, resulting in deterioration of developability of the toner. Therefore, it is preferable to control the non-electrostatic adhesion forces of a toner to be weak to impart good developability to the toner.

In the transferring process, the toner particles adhered to an electrostatic latent image formed on a photoreceptor are transferred from the photoreceptor to a receiving material. In this case, when the non-electrostatic adhesion forces of the toner are strong, the toner particles strongly adhere to the photoreceptor, and thereby the toner particles tend to remain on the surface of the photoreceptor, resulting in occurrence of a problem in that the toner particles adhere to the background area of a photoreceptor. Thus, the toner has poor transferability. Therefore, it is preferable to control the non-electrostatic adhesion forces of a toner to be weak to impart good transferability to the toner.

In the fixing process, toner particles constituting a toner image are heated and melted, and the melted toner particles are adhered to a receiving material, resulting in fixation of the toner image. In this case, when the non-electrostatic adhesion forces of the toner are strong, the affinity of the toner particles for each other increases. Therefore, the toner particles are easily melted when heated, resulting in improvement of the fixability of the toner. Therefore, it is preferable to control the non-electrostatic adhesion forces of a toner to be strong to impart good transferability to the toner.

In the cleaning process, toner particles remaining on the surface of a photoreceptor are separated from the surface of the photoreceptor. In this case, when the non-electrostatic adhesion forces of the toner are strong, the toner particles strongly adhere to the surface of the photoreceptor, and thereby the toner particles tend to remain on the surface of the photoreceptor (i.e., the toner particles are not easily separated from the surface), resulting in occurrence of the background development problem in that the toner particles adhere to the background area of the photoreceptor. Thus, the toner has poor cleanability. Therefore, it is preferable to control the non-electrostatic adhesion forces of a toner to be weak to impart good cleanability to the toner.

With respect to the environmental stability (i.e., charge stability and high temperature stability to withstand various environmental conditions), the present inventors consider that the amount of water adhered to toner particles changes as the environmental humidity changes, and thereby the chargeability of the toner is changed. In this case, when the toner has strong non-electrostatic adhesion forces, the toner particles also have a strong adhesion force against molecules of water. Namely, the toner has poor environmental stability. Therefore, it is preferable to control the non-electrostatic adhesion forces of a toner to be weak to impart good environmental stability to the toner.

As mentioned above, in order to impart good developability, transferability, cleanability and environmental stability to a toner, the non-electrostatic adhesion forces of the toner are preferably controlled so as to be weak. In order to impart good fixability to a toner, the non-electrostatic adhesion forces of the toner are preferably controlled so as to be strong. In other words, there are lower limit and upper limit for the non-electrostatic adhesion forces. As a result of the present inventors' study, the lower and upper limits of the tensile strength of a toner are preferably controlled so as to be from 900 Pa and 10,000 Pa, respectively, when the tensile strength of a pellet of the toner prepared by pressing the toner at a pressure of 15 kg/cm$^2$. In addition, the methanol wettability is preferably controlled so as to be from 25 to 65% by volume.

In addition, when the non-electrostatic adhesion forces increase, occurrence of the toner scattering problem in that toner particles contained in a developing device are scattered occurs, resulting in contamination of image forming members, thereby shortening the life of the image forming members; and/or toner particles constituting images are scattered when the images are transferred or fixed, resulting in deterioration of the transferred images and fixed images. When the toner of the present invention is used, occurrence of the toner scattering problem can be prevented. Therefore, the image forming apparatus of the present invention has good durability.

Specifically, the toner of the present invention has the following advantages of:

(1) having good charge stability even under high temperature and high humidity conditions and low temperature and low humidity conditions (i.e., the background development problem is hardly caused);

(2) hardly causing the toner scattering problem;

(3) hardly causing the spent toner problem even when several tens of thousands of images are produced;

(4) hardly causing the background development problem even when several tens of thousands of images are produced;

(5) having good low temperature fixability, wide fixable temperature range and good offset resistance (i.e., good releasability from heating members) while hardly contaminating fixing devices;

(6) having good cleanability;

(7) having good transferability (i.e., hardly producing grainy images and hollow images;

(8) having good developability (i.e., capable of producing high density images) while having a high yield; and (9) capable of improving the durability of the image forming apparatus, for which the toner is used, to an extent such that the number of maintenance operations to be performed on the image forming apparatus can be reduced.

In the present application, the tensile strength of a toner can be determined using a powder layer stress tester (AGGROBOT manufactured by Hosokawa Micron Corp. The measuring method is as follows.

At first, a predetermined amount of a toner is contained in a cylindrical cell with a diameter of 25 mm which can be separated into upper and lower cells. The toner in the cell is pressed for 60 seconds at a pressure of 15 kg/cm$^2$. Then the upper cell is gradually raised to vertically pull the toner layer (i.e., the toner pellet) formed in the cell. The maximum force (per unit area) at which the toner pellet is fractured is defined as the tensile strength of the toner. The detailed measuring conditions are as follows:

1) Amount of sample to be measured: 7 g
2) Environmental temperature: 23° C.
3) Environmental humidity: 50%
4) Inner diameter of cell: 25 mm
5) Temperature of inside of cell: 35° C.
6) Thickness of wire of spring: 1.0 mm
7) Compression speed: 0.05 mm/sec
8) Compression pressure: 15 kg/cm$^2$
9) Compression time: 60 sec
10) Pulling speed: 0.4 mm/sec.

The present inventors discover that by evaluating the tensile strength of a toner, which is measured by pressing the toners at a pressure of 15 kg/cm$^2$, the developability, transferability, and cleanability of the toner and the image qualities of the toner images can be well evaluated (i.e., the tensile strength of a toner is well correlated with the developability, transferability, and cleanability of the toner and the image qualities of the toner images).

The tensile strength of the toner of the present invention is from 900 to 10000 Pa, and more preferably from 2000 to 5000 Pa when the toner is palletized at a pressure of 15 kg/cm$^2$. When the tensile strength is too high, the non-electrostatic adhesion forces (mainly, the van der Waals' force) excessively increase, thereby deteriorating the developability, transferability, cleanability, and environmental stability. In contrast, when the tensile strength is too low, the non-electrostatic adhesion forces (mainly, the van der Waals' force) excessively decrease, thereby decreasing the fixability of the toner and causing the toner scattering problem. In addition, when the toner is mixed with a carrier to prepare a two component developer, a problem in that the toner is frictionally charged at a relatively low speed occurs.

In the present application, the methanol wettability of a toner is measured using a powder wettability tester (WET-100P from RHESCA COMPANY, LIMITED). The measuring method is as follows.

(1) at first 42 ml of pure water (ion-exchange water or marketed purified water) and 18 ml of methanol are mixed in a beaker;

(2) then 0.5 g of the toner is dispersed in the mixture solvent;

(3) the mixture in the beaker is subjected to a dispersion treatment using an ultrasonic dispersion machine (SK2200H from Shinka Industry Co., Ltd.) having a power of 90 W for 5 minutes while the beaker is sealed to prepare a toner dispersion; and (4) methanol is added to the toner dispersion at a speed of 1.2 ml/min while the mixture is agitated using a stirrer which is rotated at a revolution of 300 rpm and the transparency of the dispersion is checked to determine a transparency dropping point.

In the process (4), as methanol is added to the toner dispersion and the polarity of the solvent becomes similar to that of the toner, the toner particles, which have been floating on the mixture solvent because of not wetted with the mixture solvent, are dispersed in the mixture solvent, resulting in sudden drop of the transparency of the dispersion, which is the transparency dropping point.

The methanol wettability (MEW) is defined by the following equation:

$$MEW(\%\text{ by volume})=\{Vm/(Vm+Vw)\}\times 100$$

wherein Vm represents the total volume (ml) of methanol in the dispersion at the transparency dropping point, and Vw represents the total volume (i.e., 42 ml) of pure water.

The methanol wettability of the toner of the present invention is preferably from 25 to 65% by volume, and more preferably from 30 to 55% by volume.

When the methanol wettability is too large (i.e., the concentration of methanol in the solvent is too high), the non-electrostatic adhesion forces (liquid-crosslinking force) excessively decrease, thereby decreasing the fixability of the toner and causing the toner scattering problem. In this case, the water repellent components (such as the fluorine compounds mentioned above) of the binder resin are present on the surface of the toner particles, and thereby the toner particles are prevented from being fixed on receiving materials, resulting in deterioration of the fixability of the toner. In addition, the affinity of the toner for the hydroxyl groups of receiving papers also deteriorates, thereby increasing the lowest fixable temperature of the toner increases and deteriorating the hot offset resistance of the toner. In this case, when the toner includes a release agent, the spent toner problem tends to occur, which is caused by the release agent, resulting in deterioration of the charge stability of the toner.

In contrast, when the methanol wettability is too small (i.e., the concentration of methanol in the solvent is too low), the degree of the hydrophilic property of the toner excessively increases, thereby excessively increasing the non-electrostatic adhesion force (liquid-crosslinking force), resulting in deterioration of the developability, transferability, cleanability and environmental stability. In particular, the toner particles absorb moisture under high temperature and high humidity conditions, thereby deteriorating the chargeability of the toner, resulting in formation of low density images.

The toner of the present invention preferably includes a polyester resin as a binder resin. By using a polyester resin, a good combination of low temperature fixability and chargeability can be imparted to the toner. In addition, it is preferable to bond an ion of a compound including a fluorine atom with the surface of a polyester resin which is typically hydrophilic because water repellent property can be imparted to the toner, which results in enhancement of hydrophobicity of the toner. Therefore, the non-electrostatic adhesion forces (liquid-crosslinking force) of the toner can be decreased, thereby improving the developability, transferability, cleanability, and environmental stability.

The toner of the present invention preferably includes a modified polyester resin. When a modified polyester resin is included in the toner, the amount of hydrophilic groups such as hydroxyl groups and carboxyl groups can be relatively decreased compared with a case where an unmodified polyester resin is included in the toner. Therefore, the hydrophobic property of the toner can be enhanced, thereby increasing the non-electrostatic adhesion forces of the toner, resulting in enhancement of the developability, transferability, cleanability, and environmental.

The above-mentioned modified polyester resins can be prepared, for example by reacting a polyester prepolymer having an isocyanate group with a crosslinking agent and/or a molecular chain extension agent. The polyester prepolymer (A) can be prepared by reacting a polycondensation product of a polyol (1) and a polycarboxylic acid (2), which includes a group having an active hydrogen, with a polyisocyanate (3).

Suitable groups having an active hydrogen include a hydroxyl group (an alcoholic hydroxyl group and a phenolic hydroxyl group), an amino group, a carboxyl group, a mercapto group, etc. Among these groups, an alcoholic hydroxyl group is preferable.

Suitable polyols (1) include diols (1-1) and polyols (1-2) having three or more hydroxyl groups. Preferably, diols (1-1) or mixtures in which a small amount of a polyol (1-2) is mixed with a diol (1-1) are used.

Specific examples of the diols (1-1) include alkylene glycol (e.g., ethylene glycol, 1,2-propylene glycol, 1,3-propylene glycol, 1,4-butanediol and 1,6-hexanediol); alkylene ether glycols (e.g., diethylene glycol, triethylene glycol, dipropylene glycol, polyethylene glycol, polypropylene glycol and polytetramethylene ether glycol); alicyclic diols (e.g., 1,4-cyclohexane dimethanol and hydrogenated bisphenol A); bisphenols (e.g., bisphenol A, bisphenol F and bisphenol S); adducts of the alicyclic diols mentioned above with an alkylene oxide (e.g., ethylene oxide, propylene oxide and butylene oxide); adducts of the bisphenols mentioned above with an alkylene oxide (e.g., ethylene oxide, propylene oxide and butylene oxide); etc.

Among these compounds, alkylene glycols having from 2 to 12 carbon atoms and adducts of bisphenols with an alkylene oxide are preferable. More preferably, adducts of bisphenols with an alkylene oxide, or mixtures of an adduct of bisphenols with an alkylene oxide and an alkylene glycol having from 2 to 12 carbon atoms are used.

Specific examples of the polyols (1-2) include aliphatic alcohols having three or more hydroxyl groups (e.g., glycerin, trimethylol ethane, trimethylol propane, pentaerythritol and sorbitol); polyphenols having three or more hydroxyl groups (trisphenol PA, phenol novolak and cresol novolak); adducts of the polyphenols mentioned above with an alkylene oxide; etc.

Suitable polycarboxylic acids (2) include dicarboxylic acids (2-1) and polycarboxylic acids (2-2) having three or more carboxyl groups. Preferably, dicarboxylic acids (2-1) or mixtures in which a small amount of a polycarboxylic acid (2-2) is mixed with a dicarboxylic acid (2-1) are used.

Specific examples of the dicarboxylic acids (2-1) include alkylene dicarboxylic acids (e.g., succinic acid, adipic acid and sebacic acid); alkenylene dicarboxylic acids (e.g., maleic acid and fumaric acid); aromatic dicarboxylic acids (e.g., phthalic acid, isophthalic acid, terephthalic acid and naphthalene dicarboxylic acids; etc. Among these compounds, alkenylene dicarboxylic acids having from 4 to 20 carbon atoms and aromatic dicarboxylic acids having from 8 to 20 carbon atoms are preferably used.

Specific examples of the polycarboxylic acids (2-2) having three or more hydroxyl groups include aromatic polycarboxylic acids having from 9 to 20 carbon atoms (e.g., trimellitic acid and pyromellitic acid).

As for the polycarboxylic acid (2), anhydrides or lower alkyl esters (e.g., methyl esters, ethyl esters or isopropyl esters) of the polycarboxylic acids mentioned above can be used for the reaction with a polyol (1).

Suitable mixing ratio (i.e., an equivalence ratio [OH]/[COOH]) of (the [OH] of) a polyol (1) to (the [COOH] of) a polycarboxylic acid (2) is from 2/1 to 1/1, preferably from 1.5/1 to 1/1 and more preferably from 1.3/1 to 1.02/1.

Specific examples of the polyisocyanates (3) include aliphatic polyisocyanates (e.g., tetramethylene diisocyanate, hexamethylene diisocyanate and 2,6-diisocyanate methylcaproate); alicyclic polyisocyanates (e.g., isophorone diisocyanate and cyclohexylmethane diisocyanate); aromatic didicosycantes (e.g., tolylene diisocyanate and diphenylmethane diisocyanate); aromatic aliphatic diisocyanates (e.g., α, α, α', α'-tetramethyl xylylene diisocyanate); isocyanurates; blocked polyisocyanates in which the polyisocyanates mentioned above are blocked with phenol derivatives, oximes or caprolactams; etc. These compounds can be used alone or in combination.

Suitable mixing ratio (i.e., [NCO]/[OH]) of (the [NCO] of) a polyisocyanate (3) to (the [OH] of) a polyester is from 5/1 to 1/1, preferably from 4/1 to 1.2/1 and more preferably from 2.5/1 to 1.5/1. When the [NCO]/[OH] ratio is too large, the low temperature fixability of the toner deteriorates. In contrast, when the ratio is too small, the content of the urea group in the modified polyesters decreases and thereby the hot offset resistance of the toner deteriorates. The content of the constitutional component of a polyisocyanate (3) in the polyester prepolymer (A) having a polyisocyanate group at its end portion is from 0.5 to 40% by weight, preferably from 1 to 30% by weight and more preferably from 2 to 20% by weight. When the content is too low, the hot offset resistance of the toner deteriorates and in addition the heat resistance and low temperature fixability of the toner also deteriorate. In contrast, when the content is too high, the low temperature fixability of the toner deteriorates.

The number of the isocyanate group included in a molecule of the polyester prepolymer (A) is not less than 1, preferably from 1.5 to 3, and more preferably from 1.8 to 2.5. When the number of the isocyanate group is too small, the molecular weight of the resultant urea-modified polyester decreases and thereby the hot offset resistance deteriorate.

Amines can be used as the crosslinking agent and/or the molecular chain extension agent. Specific examples of the amines (B) include diamines (B1), polyamines (B2) having three or more amino groups, amino alcohols (B3), amino mercaptans (B4), amino acids (B5) and blocked amines (B6) in which the amines (B1-B5) mentioned above are blocked.

Specific examples of the diamines (B1) include aromatic diamines (e.g., phenylene diamine, diethyltoluene diamine and 4,4'-diaminodiphenyl methane); alicyclic diamines (e.g., 4,4'-diamino-3,3'-dimethyldicyclohexyl methane, diaminocyclohexane and isophorone diamine); aliphatic diamines (e.g., ethylene diamine, tetramethylene diamine and hexamethylene diamine); etc.

Specific examples of the polyamines (B2) having three or more amino groups include diethylene triamine, triethylene tetramine. Specific examples of the amino alcohols (B3) include ethanol amine and hydroxyethyl aniline. Specific examples of the amino mercaptan (B4) include aminoethyl mercaptan and aminopropyl mercaptan. Specific examples of the amino acids (5) include amino propionic acid and amino caproic acid. Specific examples of the blocked amines (B6) include ketimine compounds which are prepared by reacting one of the amines B1-B5 mentioned above with a ketone such as acetone, methyl ethyl ketone and methyl isobutyl ketone; oxazoline compounds, etc. Among these compounds, diamines (B1) and mixtures in which a diamine is mixed with a small amount of a polyamine (B2) are preferably used.

The molecular weight of the urea-modified polyesters can be controlled using a molecular chain extension inhibitor, if desired. Specific examples of the elongation inhibitor include monoamines (e.g., diethyl amine, dibutyl amine, butyl amine and lauryl amine), and blocked amines (i.e., ketimine compounds) prepared by blocking the monoamines mentioned above.

The mixing ratio (i.e., a ratio [NCO]/[NHx]) of (the [NCO] of) the prepolymer (A) having an isocyanate group to (the [NHx] of) the amine (B) is from 1/2 to 2/1, preferably from 1.5/1 to 1/1.5 and more preferably from 1.2/1 to 1/1.2. When the mixing ratio is too low or too high, the molecular weight of the resultant urea-modified polyester decreases, resulting in deterioration of the hot offset resistance of the resultant toner.

It is preferable for the toner of the present invention to include a combination of a urea-modified polyester resin and an unmodified polyester resin as the binder resin. The mixing ratio (MPE/UMPE) of a modified polyester resin (MPE) to an unmodified polyester resin (UMPE) is from 5/95 to 80/20. By using such a polyester resin combination, the hydrophobicity of the binder resin can be enhanced and in addition the low temperature fixability and glossiness of the toner can also be enhanced.

When the mixing ratio (MPE/UMPE) is too low, the binder resin has strong hydrophilicity. Therefore the toner has strong hydrophilicity, and thereby the non-electrostatic adhesion forces of the toner are increased, resulting in deterioration of the developability, transferability, cleanability, and environmental stability of the toner although the fixability of the toner can be enhanced. In addition, the hot offset resistance of the toner deteriorates and a good combination of high temperature preservability and low temperature fixability cannot be imparted to the toner.

In contrast, when the mixing ratio (MPE/UMPE) is too high, the hydrophobicity is excessively increased. Therefore, the non-electrostatic adhesion forces of the toner decrease, and the low temperature fixability and fixability of the toner also deteriorate. In addition, the glossiness of toner images also decreases when the toner is used for fall color image forming apparatus.

Suitable materials for use as the unmodified polyester resins (UMPE) include polycondensation products of a polyol (1) with a polycarboxylic acid (2). Specific examples of the polyol (1) and polycarboxylic acid (2) are mentioned above for use in the modified polyester resins. In addition, specific examples of the suitable polyol and polycarboxylic acid are also mentioned above.

In addition, polyester resins modified by a bonding (such as urethane bonding) other than a urea bonding are considered as the unmodified polyester resin in the present application.

When a combination of a modified polyester resin and an unmodified polyester resin is used as the binder resin, it is preferable that the modified polyester resin is at least partially mixed with the unmodified polyester resin to improve the low temperature fixability and hot offset resistance of the toner. Namely, it is preferable that the modified polyester resin has a molecular structure similar to that of the unmodified polyester resin. The mixing ratio (MPE/UMPE) of a modified polyester resin (MPE) to an unmodified polyester resin (UMPE) is from 5/95 to 80/20, preferably from 10/90 to 25/75, more preferably from 12/88 to 25/75, and even more preferably from 12/88 to 22/78.

The peak molecular weight of the unmodified polyester resins (UMPE) is from 1,000 to 30,000, preferably from 1,500 to 10,000 and more preferably from 2,000 to 8,000. When the peak molecular weight is too low, the high temperature preservability of the toner deteriorates. In contrast, when the peak molecular weight is too high, the low temperature fixability of the toner deteriorates.

The unmodified polyester resin (UMPE) preferably has a hydroxyl value not less than 5 mgKOH/g, and more preferably from 10 to 120 mgKOH/g, and even more preferably from 20 to 80 mgKOH/g. When the hydroxyl value is too small, the resultant toner cannot has a good combination of high temperature preservability and low temperature fixability.

The unmodified polyester resin (UMPE) preferably has an acid value of from 0.5 to 40 mgKOH/g, and more preferably from 5 to 35 mgKOH/g. When an unmodified polyester resin having such an acid value is used, good negative charge property can be imparted to the toner. In addition, when the acid value and the hydroxyl value are too high, the toner is easily influenced by environmental conditions. Specifically, under high temperature and high humidity conditions or low temperature and low humidity conditions, image qualities deteriorate.

The toner of the present invention preferably includes an ion of a compound having a fluorine atom. In this case, the ion having a fluorine atom can be adhered to the surface of the binder resin of the toner, and thereby good negative chargeability can be imparted to the toner due to the fluorine atom, which has high electronegativity. In addition, the hydrophobicity of the toner can also be enhanced, thereby decreasing the non-electrostatic adhesion forces of the toner. Therefore, the developability, transferability, cleanability and environmental stability can be enhanced.

Suitable ions for use as the above-mentioned ion include ions of organic and inorganic compounds including a fluorine atom.

Among these ions, ions having the following formula (I) are preferably used.

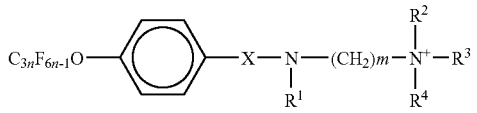

(I)

wherein X represents —$SO_2$— or —CO—; each of $R^1$, $R^2$, $R^3$ and $R^4$ represents a hydrogen atom, an alkyl group having from 1 to 10 carbon atoms, or an aryl group having from 6 to 18 carbon atoms; and each of m and n is a positive integer.

By bonding such an ion with the surface of the binder resin of the toner of the present invention, the hydrophobicity of the binder resin, i.e., the hydrophobicity of the toner, can be enhanced. By controlling the amount of the ion, the degree of hydrophobicity of the toner can be controlled. When the toner includes a polyester resin, the ammonium ion of the ion having formula (1) can be bonded with the carboxyl group of the polyester resin. Therefore, the hydrogen ion of the carboxyl group of the polyester resin, which is a hydrophilic group, can be substituted with the ion having formula (1) including a fluorine atom, which is a hydrophobic group.

Since the ions having formula (1) typically have a color of white or pale yellow, the color of the toner is hardly influenced by the ions.

Specific examples of the alkyl groups for use in the ions having formula (1) include alkyl groups having 1 to 10 carbon atoms such as methyl, ethyl, n-propyl, isopropyl, n-butyl, iso-butyl, sec-butyl, tert-butyl, (linear or branched) pentyl, (linear or branched) hexyl, (linear or branched) heptyl, (linear or branched) octyl, (linear or branched) nonyl, and (linear or branched) decyl groups.

Specific examples of the aryl groups include aryl groups having 6 to 18 carbon atoms such as phenyl, 1- or 2-naphthalenyl, 1-, 2- or 9-anthracenyl and 1-, 2-, 3-, 4- or 9-phenanthrenyl groups.

In formula (1), each of m and n is an integer of from 1 to 10.

When the toner of the present invention includes an ion having formula (1), the atomic ratio (F/C) of the fluorine atom to the carbon atom at the surface of the toner is preferably from 0.010 to 0.110. In this regard, the fluorine atoms and the carbon atoms present on the surface of the toner are typically the fluorine atoms of the ions having formula (1), and carbon atoms of the binder resin, respectively. When the ratio (F/C) falls in the above-mentioned range, the chargeability, fixability and hydrophobicity of the toner can be properly controlled. The fluorine atoms present on the surface of the toner increase the negative chargeability of the toner because of having high electronegativity. In addition, since fluorine atoms have good water repellent property, the hydrophobicity of the toner can be enhanced, resulting in decrease of the non-electrostatic adhesion force of the toner.

Therefore, when the ratio (F/C) is too low, it becomes difficult to impart good negative chargeability to the toner. In addition, the toner has poor hydrophobicity, thereby increasing the non-electrostatic adhesion forces, resulting in deterioration of the developability, transferability, cleanability, and environmental stability.

On the other hand, since fluorine atoms have water-repellent property, the affinity of the toner for receiving papers which have many hydroxyl groups, deteriorates if the ratio (F/C) is too high, resulting in deterioration of the low temperature fixability of the toner. In addition, the tolerance of the offset resistance decreases, and thereby a problem in that the toner is adhered to a fixing member such as fixing belts and fixing rollers occurs.

The ratio (F/C) can be determined by subjecting the toner to X-ray photoelectron spectroscopy (XPS). The measuring method is as follows.

(1) a sample (i.e., a toner) is set on an aluminum plate and the toner is patted down; and (2) the sample is subjected to an X-ray photoelectron spectroscopy (XPS) analysis using an X-ray photoelectron spectrometer 1600S manufactured by PHI.

The measurement conditions are as follows.

X ray: MgKα (power of 100 W)

Measurement area: 0.8 mm×2.0 mm of the patted toner layer

The toner of the present invention preferably includes a hydrophobized particulate inorganic material (hereinafter referred to as a first particulate inorganic material) having a primary particle diameter of from 30 nm to 150 nm, which is located on a surface of the toner particles. When such an inorganic material having a relatively large primary particle diameter is present on a surface of the toner particles, distances between the toner particles are widened, thereby decreasing the van der Waals' force. Therefore, the developability, transferability, cleanability and environmental stability of the toner can be enhanced.

It is preferable for the toner of the present invention to further include a hydrophobized second particulate inorganic material having a primary particle diameter of from 1 to 20 nm, which is also located on a surface of the toner particles. When such a second inorganic material having a relatively small primary particle diameter is present on a surface of the toner particles, the fluidity of the toner can be improved, thereby improving the chargeability and charge stability to withstand various environmental conditions. In addition, the feeding property of the toner can also be improved, and thereby occurrence of a problem in that a waste toner passage provided in an image forming apparatus is clogged with waste toner particles can be prevented.

Since inorganic materials have a hydrophilic group at the end portion thereof, the first and second particulate inorganic materials are preferably treated with a hydrophobizing agent. By controlling the hydrophobicity of the first and second particulate inorganic materials, the hydrophobicity of the toner can be controlled, i.e., the non-electrostatic adhesion forces of the toner can be controlled. In this regard, the first and second particulate inorganic materials are present on a surface of the toner while achieving a state near the primary state. The first particulate inorganic material prevents the second particulate inorganic material from being embedded into the toner particles even when the toner particles receive a stress in a development process. Therefore, the charge stability to withstand various environmental conditions, transferability and cleanability of the toner can be improved even after long repeated use (e.g., even after production of several tens of thousands of images).

In order to supplementarily improve the fluidity, developability and chargeability of the toner, particulate organic materials and particulate inorganic materials can be used, as external additives, in combination with the first and second particulate inorganic materials. External additives greatly influence the adhesion force and hydrophobicity of the toner. Therefore, it is preferable to properly control the tensile strength and the methanol wettability of the toner by choosing a proper method for adhering the external additives and controlling the added amount of the external additives so that the surface of the toner particles can be properly covered with the external additives.

A combination of a particulate inorganic material and a hydrophobized particulate inorganic material can be used as external additives. However, it is preferable to use at least two kinds of inorganic particulate materials, one of which is a hydrophobized small particulate inorganic material having an average primary particle diameter of from 1 to 20 nm and preferably from 6 to 15 nm, and a specific surface area of from 100 to 400 $m^2/g$ which is measured by a BET method and the other of which is a hydrophobized large particulate inorganic material having an average primary particle diameter of from 30 to 150 nm and preferably from 90 to 130 nm, and a specific surface area of from 20 to 100 $m^2/g$. As the small particulate inorganic material, a combination of a silica and a titanium oxide is preferably used. As the large particulate inorganic material, a silica is preferably used. In this regard, silica prepared by a wet process such as sol-gel methods is preferably used. In addition, it is preferable to use a medium particulate inorganic material, as an external additive, which has an average primary particle diameter of from 20 to 50 nm and a specific surface area of from 40 to 100 $m^2/g$. Silica is preferably used as the medium particulate inorganic material.

Known inorganic materials can be used as external additives as long as the above-mentioned conditions are satisfied. Specific examples of such inorganic materials include silica, hydrophobized silica, fatty acid metal salts (e.g., zinc stearate and aluminum stearate), metal oxides (e.g., titania, alumina, tin oxide, and antimony oxide), fluoropolymers, etc.

Suitable materials for use as the external additive of the toner of the present invention include silica, titanium oxide, aluminum oxide, etc., which are preferably hydrophobized. Specific examples of the silica include HDK H 2000, HDK H 2000/4, HDK H 2050EP, HVK21 and HDK H 1303, which are manufactured by Hoechst AG; and R972, R974, RX200, RY200, R202, R805 and R812, which are manufactured by Nippon Aerosil Co. Specific examples of the titanium oxide include P-25 manufactured by Nippon Aerosil Co.; STT-30 and STT-65C-S, which are manufactured by Titan Kogyo K.K.; TAF-140 manufactured by Fuji Titanium Industry Co., Ltd.; MT-150W, MT-500B, MT-600B and MT-150A, which are manufactured by Tayca Corp.; etc. Specific examples of the hydrophobized titanium oxides include T-805 manufactured by Nippon Aerosil Co.; STT-30A and STT-65S-S, which are manufactured by Titan Kogyo K.K.; TAF-500T and TAF-1500T, which are manufactured by Fuji Titanium Industry Co., Ltd.; MT-100S and MT-100T, which are manufactured by Tayca Corp.; IT-S manufactured by Ishihara Sangyo Kaisha K.K.; etc.

Suitable hydrophobizing agents for use in the hydrophobizing treatment of the inorganic materials (such as silica, titanium oxide and aluminium oxide) include silane coupling agents such as methyl trimethoxy silane, methyl triethoxy silane, and octyl trimethoxy silane; and silicone oils. Specific examples of the silicone oils include dimethyl silicone oils, methylphenyl silicone oils, chrolophenyl silicone oils, methylhydrodiene silicone oils, alkyl-modified silicone oils, fluorine-modified silicone oils, polyether-modified silicone oils, alcohol-modified silicone oils, amino-modified silicone oils, epoxy-modified silicone oils, epoxy/polyether-modified silicone oils, phenol-modified silicone oils, carboxyl-modified silicone oils, mercapto-modified silicone oils, (meth)acrylic-modified silicone oils, α-methylstyrene-modified silicone oils, etc.

Specific examples of the particulate inorganic materials to be treated include silica, aluminum oxide, titanium oxide, barium titanate, magnesium titanate, calcium titanate, strontium titanate, iron oxide, copper oxide, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, silicon nitride, etc.

Among these inorganic materials, silica and titanium oxide are preferably used.

The added amount of such particulate inorganic materials is from 0.1 to 5% by weight, and preferably from 0.3 to 3% by weight, based on the total weight of the toner. The average primary particle diameter of the inorganic materials is from 1 to 100 nm, and preferably from 3 to 70 nm. When the average primary particle diameter is too small, the inorganic materials tend to be embedded into toner particles, and thereby the function of the external additive cannot be fulfilled. In contrast, when the average primary particle diameter is too large, a problem in that a surface of the photoreceptor used is damaged by the external additive is caused.

In addition, particulate polymers such as polymers and copolymers of styrene, methacrylate and acrylate, which are prepared by a method such as soap-free emulsion polymerization methods, suspension polymerization methods, and dispersion polymerization methods; polycondensation resins such as silicone resins, benzoguanamine resins and nylon resins; and thermosetting resins, can be used as external additives. These particulate polymers are preferably treated with a hydrophobizing agent to improve the hydrophobicity of the polymers, i.e., to prevent deterioration of fluidity and charge properties even under high humidity conditions. Specific examples of such hydrophobizing agents include silane coupling agents, silylation agents, silane coupling agents including a fluorinated alkyl group, organic titanate coupling agents, aluminum coupling agents, silicone oils, modified silicone oils, etc.

The toner of the present invention preferably includes a cleanability improving agent which can impart good cleaning property to the toner such that the toner remaining on the surface of an image bearing member such as photoreceptors even after a toner image is transferred can be easily removed. Specific examples of such a cleanability improving agent include fatty acids and metal salts of fatty acids such as stearic acid, zinc stearate and calcium stearate; and particulate polymers such as polymethyl methacrylate and polystyrene, which are manufactured by a method such as soap-free emulsion polymerization methods.

Particulate resins having a relatively narrow particle diameter distribution and a volume average particle diameter of from 0.01 μm to 1 μm are preferably used as the cleanability improving agent.

Suitable methods for use in adhering an external additive to a toner include dry methods using a mixer such as HENSCHEL MIXERS and Q mixers; and wet methods in which a particulate is adhered to toner particles in a liquid including a solvent and water and optionally including a surfactant which is added to improve the wettability of the toner particles.

The toner of the present invention preferably has an average circularity of from 0.90 to 0.99 (i.e., toner particles have substantially a circular form), and more preferably from 0.94 to 0.99. In addition, it is preferable that toner particles having a circularity less than 0.94 are included in the toner in an amount not greater than 10%. When the toner has such a circular form, an ion having formula (1) can be easily bonded to the surface of the toner particles, and thereby the hydrophobicity of the toner can be easily controlled. In addition, a toner having a circular form has a low surface energy, and thereby the van der Waals' force of the toner particles can be decreased. Therefore, the developability, transferability, cleanability, and environmental stability can be easily enhanced, and images having proper image density and high resolution can be produced.

When the circularity of the toner is too low (i.e., the toner particles have forms far apart from the circular form), the non-electrostatic adhesion force of the toner increases, thereby deteriorating the developability, transferability, cleanability, and environmental stability. In contrast, when the circularity is too high (i.e., the toner particles have substantially a perfectly circular form), the cleanability of the toner deteriorates.

The average circularity of the toner particles was determined as follows using a flow-type particle image analyzer FPIA-1000 from Sysmex Corp.:

(1) at first 100 to 150 ml of water from which solid foreign materials have been removed, 0.1 to 0.5 ml of a surfactant (alkylbenzenesulfonate) and 0.1 to 0.5 g of the toner particles were mixed to prepare a dispersion;

(2) the dispersion is further subjected to a supersonic dispersion treatment for 1 to 3 minutes using a supersonic dispersion machine SK2200H manufactured by Shika Industry Co., Ltd. and having a power of 90 W to prepare a dispersion including particles of from 3,000 to 10,000 pieces/μl;

(3) the dispersion is passed through a detection area formed on a plate in the measuring instrument; and (4) the particles are optically detected by a CCD camera and then the shapes thereof are analyzed with an image analyzer.

The circularity of a particle is determined by the following equation:

$$\text{Circularity}=Cs/Cp,$$

wherein Cp represents the length of the circumference of the projected image of a particle and Cs represents the length of the circumference of a circle having the same area as that of the projected image of the particle.

The average circularity is obtained by averaging circularities of toner particles.

The toner of the present invention preferably has a form factor SF-1 of from 103 to 150, and more preferably from 105 to 140. When the form factor SF-1 falls in this range, the toner particles have forms (elliptical forms) near the true spherical form. In addition, the toner preferably has a form factor SF-2 of form 101 to 140, and more preferably from 105 to 130. When the form factor SF-2 falls in this range, the toner particles have surfaces which are not so roughened. Therefore, an ion having formula (1) can be easily adhered to the surface of the toner particles, and thereby the hydrophobicity of the toner can be easily controlled. In addition, a toner having a near-circular form has a low surface energy, and thereby the van der Waals' force of the toner particles can be decreased. Therefore, the developability, transferability, cleanability, and environmental stability can be easily enhanced.

When the SF-1 is too small (i.e., when the SF-1 is near 100, namely, the toner particles have substantially a perfectly circular form), the cleanability of the toner deteriorates. In contrast, when the SF-1 is too large (i.e., when the toner particles have irregular forms), the non-electrostatic adhesion force of the toner increases, thereby deteriorating the developability, transferability, cleanability, and environmental stability of the toner.

When the SF-2 is too small (i.e., when the toner particles have too smooth surface), the cleanability of the toner deteriorates. In contrast, when the SF-2 is too large (i.e., when the toner particles have irregular forms), the non-electrostatic adhesion force of the toner increases, thereby deteriorating the developability, transferability, cleanability, and environmental stability of the toner.

The form factors SF-1 and SF-2 are determined by the following method:

(1) a photograph of particles of a toner is taken using a scanning electron microscope (FE-SEM S-4200, manufactured by Hitachi Ltd.); and (2) particle images of 300 toner particles, which are randomly selected, are analyzed using an image analyzer (LUZEX AP manufactured by Nireco Corp.) through an interface.

The form factor SF-1 is defined by the following equation:

$$SF\text{-}1=(L^2/A)\times(\pi/4)\times 100$$

wherein L represents a diameter of the circle circumscribing the image of a toner particle, which image is obtained by observing the toner particle with the microscope; and A represents the area of the image.

The form factor SF-2 is defined by the following equation:

$$SF\text{-}2=(P^2/A)\times(1/4\pi)\times 100$$

wherein P represents the peripheral length of the image of a toner particle observed by the microscope; and A represents the area of the image.

If the toner has a true spherical form, each of the form factors SF-1 and SF-2 is 100. As the form factors SF-1 and SF-2 of a toner particle increase, the form of the toner particle is changed from a spherical form to an irregular form.

The toner of the present invention preferably has a volume average particle diameter of form 2 to 7 μm. In this case, the toner has a good combination of developability, transferability, cleanability and environmental stability. . When the volume average particle diameter is too small, the transferability and cleanability of the toner deteriorate. In addition, when the toner is used for two component developers, a problem which occurs is that the toner is fused and adhered to the carrier used, thereby deteriorating the chargeability of the carrier. When the toner is used for one component developers, a problem which occurs is that a toner film is formed on a developing roller, a toner regulating blade and other members.

In contrast, when the volume average particle diameter is too large, the total surface area of toner particles having a unit weight decreases. Therefore, the amount of ions having formula (1) which are adhered to the surface of the toner particles decreases, resulting in deterioration of the hydrophobicity of the toner (i.e., decrease of the non-electrostatic adhesion force). Accordingly, it is impossible to impart a good combination of developability, transferability, and environmental stability to the toner. In addition, high quality images cannot be produced. Further, the particle diameter distribution of toner particles used for an image forming apparatus largely changes when a fresh toner is replenished to the image forming apparatus, resulting in variation of image qualities.

The toner of the present invention preferably has a ratio (Dv/Dn) of the volume average particle diameter (Dv) of the toner to the number average particle diameter (Dn) thereof of not greater than 1.15, and more preferably from 1.03 to 1.15. As the ratio (Dv/Dn) approaches 1.0, the toner has a sharper particle diameter distribution.

When the ratio (Dv/Dn) is too large, the toner particles have wide particle diameter distribution. Therefore, it becomes impossible to control the transferability and cleanability of the toner. In addition, the amount of ions having formula (1) located on the toner particles is also varied, and therefore it becomes impossible to control the non-electrostatic adhesion force of the toner particles. Therefore, it is impossible to properly control the developability, transferability and environmental stability of the toner.

The number average particle diameter (Dn) and the volume average particle diameter (Dv) can be determined by a COULTER COUNTER MULTISIZER manufactured by Beckman Coulter Inc.

When the toner has a volume average particle diameter of from 2 to 7 μm and a ratio (Dv/Dn) of not greater than 1.15, the toner has a good combination of developability, transferability and environmental stability, and in addition the toner can produce color images with high glossiness when used for full color image forming apparatus.

The toner of the present invention preferably has a glass transition temperature (Tg) of from 40 to 70° C., and more preferably from 45 to 55° C. When the glass transition temperature is too low, the high temperature preservability of the toner deteriorates. In contrast, when the glass transition temperature is too high, the low temperature fixability of the toner deteriorates. The toner of the present invention, which includes one or more of the above-mentioned modified polyester resins which are crosslinked and/or extended has relatively good preservability compared to conventional toners including known polyester resins even when the glass transition temperature is lower than those of the conventional toners.

The toner of the present invention preferably has the following property concerning storage modulus. Specifically, the temperature (TG') at which the toner has a storage modulus of 10,000 dyne/cm$^2$ at a frequency of 20 Hz is not lower than 100° C., and preferably from 110 to 200° C. When the temperature (TG') is too low, the hot offset resistance of the toner deteriorates.

In addition, toner of the present invention preferably has the following property concerning viscosity. Specifically, the temperature (Tη) at which the toner has a viscosity of 1,000 dyne/cm$^2$ at a frequency of 20 Hz is not higher than 180° C., and preferably from 90 to 160° C. When the temperature (Tη) is too high, the low temperature fixability of the toner deteriorates.

In order to impart a good combination of low temperature fixability and hot offset resistance to the toner, it is preferable that the TG' is higher than the Tη. Specifically, the difference (TG'−Tη) is preferably not less than 0° C., more preferably not less than 10° C. and even more preferably not less than 20° C. The difference particularly has an upper limit. In order to impart a good combination of high temperature preservability and low temperature fixability to the toner, the difference (TG'−Tη) is preferably from 0 to 100° C., more preferably from 10 to 90° C. and even more preferably from 20 to 80° C.

The toner of the present invention includes a colorant. Suitable materials for use as the colorant include known dyes and pigments.

Specific examples of the dyes and pigments include carbon black, Nigrosine dyes, black iron oxide, NAPHTHOL YELLOW S (C.I. 10316), HANSA YELLOW 10G (C.I. 11710), HANSA YELLOW 5G (C.I. 11660), HANSA YELLOW G (C.I. 11680), Cadmium Yellow, yellow iron oxide, loess, chrome yellow, Titan Yellow, polyazo yellow, Oil Yellow, HANSA YELLOW GR (C.I. 11730), HANSA YELLOW A (C.I. 11735), HANSA YELLOW RN (C.I. 11740), HANSA YELLOW R (C.I. 12710), PIGMENT YELLOW L (C.I. 12720), BENZIDINE YELLOW G (C.I. 21095), BENZIDINE YELLOW GR (C.I. 21100), PERMANENT YELLOW NCG (C.I. 20040), VULCAN FAST YELLOW 5G (C.I. 21220), VULCAN FAST YELLOW R (C.I. 21135), Tartrazine Lake, QUINOLINE YELLOW LAKE, ANTHRAZANE YELLOW BGL (C.I. 60520), isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, BRILLIANT CARMINE BS, PERMANENT RED F2R (C.I. 12310), PERMANENT RED F4R (C.I. 12335), PERMANENT RED FRL (C.I. 12440), PERMANENT RED FRLL (C.I. 12460), PERMANENT RED F4RH (C.I. 12420), Fast Scarlet VD, VULCAN FAST RUBINE B (C.I. 12320), BRILLIANT SCARLET G. LITHOL RUBINE GX (C.I. 12825), PERMANENT RED F5R, BRILLIANT CARMINE 6B, Pigment Scarlet 3B, Bordeaux 5B, Toluidine Maroon, PERMANENT BORDEAUX F2K (C.I. 12170), HELIO BORDEAUX BL (C.I. 14830), BORDEAUX 10B, BON MAROON LIGHT (C.I. 15825), BON MAROON MEDIUM (C.I. 15880), Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE RS (C.I. 69800), INDANTHRENE BLUE BC (C.I. 69825), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like. These materials are used alone or in combination.

The content of the colorant in the toner is preferably from 1 to 15% by weight, and more preferably from 3 to 10% by weight of the toner.

Master batches, which are complexes of a colorant with a resin, can be used as the colorant of the toner of the present invention.

Specific examples of the resins for use as the binder resin of the master batches include polymers of styrene or styrene derivatives, styrene copolymers, polymethyl methacrylate, polybutyl methacrylate, polyvinyl chloride, polyvinyl acetate, polyethylene, polypropylene, polyesters, epoxy resins, epoxy polyol resins, polyurethane resins, polyamide resins, polyvinyl butyral resins, acrylic resins, rosin, modified rosins, terpene resins, aliphatic or alicyclic hydrocarbon resins, aromatic petroleum resins, chlorinated paraffin, paraffin waxes, etc. These can be used alone or in combination.

Specific examples of the polymers of styrene or styrene derivatives include polystyrene, poly-p-chlorostyrene and polyvinyltoluene. Specific examples of the styrene copolymers include styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers and styrene-maleic acid ester copolymers.

The master batches can be prepared by mixing one or more of the resins as mentioned above and one or more of the colorants as mentioned above and kneading the mixture while applying a high shearing force thereto. In this case, an organic solvent can be added to increase the interaction between the colorant and the resin. In addition, a flushing method in which an aqueous paste including a colorant and water is mixed with a resin dissolved in an organic solvent and kneaded so that the colorant is transferred to the resin side (i.e., the oil phase), and then the organic solvent (and water, if desired) is removed can be preferably used because the resultant wet cake can be used as it is without being dried. When performing the mixing and kneading process, dispersing devices capable of applying a high shearing force such as three roll mills can be preferably used.

The toner of the present invention can include a release agent. Suitable materials for use as the release agent include waxes. Specific examples of the waxes include polyolefin waxes (e.g., low molecular weight polyethylene and polypropylene); long chain hydrocarbons (e.g., paraffin waxes and SASOL WAX); and carbonyl group containing waxes. Among these waxes, the carbonyl group containing waxes are preferably used. Specific examples of the carbonyl group containing waxes include esters of polyalkanoic acids such as camauba waxes, montan waxes, trimethylolpropane tribehenate, pentaerythritol tetrabehenate, pentaerythritol diacetatedibehenate, glycerin tribehenate, and 1,18-octadecanediol distearate; polyalcanol esters such as tristearyl trimellitate, and distearyl maleate; polyalkanoic acid amides such as ethylenediamine dibehenyl amide; polyalkylamides such as trimellitic acid tristearylamide; dialkyl ketones such as distearyl ketone; etc. Among the carbonyl group containing waxes, esters of polyalkanoic acids are preferably used.

The release agent (wax) for use in the toner of the present invention preferably has a melting point of from 40 to 160° C., more preferably from 50 to 120° C., and even more preferably from 60 to 90° C.

When the melting point is too low, the resultant toner has poor high temperature preservability. In contrast, when the melting point is too high, the toner causes a cold offset problem in that a part of a toner image is adhered to a fixing roller at a relatively low fixing temperature, resulting in production of abnormal images.

The release agent (wax) included in the toner of the present invention preferably has a melt viscosity of from 5 to 1000 cps and more preferably from 10 to 100 cps when the melt viscosity is measured at a temperature 20° C. higher that the melting point of the wax. When the melt viscosity is too high, good hot offset resistance and good low temperature fixability cannot be imparted to the toner.

The release agent (wax) is typically included in the toner in an amount of from 0 to 40 parts by weight, and preferably from 3 to 30 parts by weight, per 100 parts by weight of the toner.

The toner of the present invention can include a charge controlling agent other than the ions of compounds including a fluorine atom, if desired. Any known charge controlling agents can be used for the toner.

Suitable examples of the charge controlling agents include Nigrosine dyes, triphenyl methane dyes, chromium-containing metal complex dyes, molybdic acid chelate pigments, Rhodamine dyes, alkoxyamines, quaternary ammonium salts, fluorine-modified quaternary ammonium salts, alkylamides, phosphor and its compounds, tungsten and its compounds, fluorine-containing activators, metal salts of salicylic acid, metal salts of salicylic acid derivatives, etc.

Specific examples of the marketed charge controlling agents include BONTRON® 03 (Nigrosine dye), BONTRON® P-51 (quaternary ammonium salt), BONTRON® S-34 (metal containing azo dye), BONTRON® E-82 (metal complex of oxynaphthoic acid), BONTRON® E-84 (metal complex of salicylic acid), and BONTRON® E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE® PSY VP2038 (quaternary ammonium salt), COPY BLUE® PR (triphenyl methane derivative), COPY CHARGE® NEG VP2036 and COPY CHARGE® NX VP434 (quaternary ammonium salt), which are manufactured by Hoechst AG; LRA-901, and LR-147 (boron complex), which are manufactured by Japan Carlit Co., Ltd.; copper phthalocyanine, perylene, quinacridone, azo pigments, polymers having a functional group such as a sulfonate group, a carboxyl group, a quaternary ammonium group, etc.

The content of the charge controlling agent in the toner of the present invention is determined depending on the variables such as choice of binder resin, presence of additives, and dispersion method. In general, the content of the charge controlling agent is preferably from 0.1 to 10 parts by weight, and more preferably from 0.2 to 5 parts by weight, per 100 parts by weight of the binder resin included in the toner. When the content is too high, the charge quantity of the toner excessively increases, and thereby the electrostatic attraction between the developing roller and the toner increases, resulting in deterioration of fluidity and decrease of image density.

The charge controlling agent can be included in the toner by a method in which the charge controlling agent is added to a mixture of a resin and a colorant which are heated and kneaded; a method in which the charge controlling agent is added to a solution or dispersion of a resin and a colorant in an organic solvent; or a method in which the charge controlling agent is fixed on a surface of the toner after toner particles are prepared.

The toner of the present invention can include a particulate resin, if desired. The particulate preferably has a glass transition temperature (Tg) of from 40 to 100° C. and a weight average molecular weight of from 9,000 to 200,000. When the glass transition temperature is too low and/or the weight average molecular weight is too low, the toner has poor preservability. In contrast, when the glass transition temperature is too high and/or the weight average molecular weight is too high, the particulate resin inhibits adhesion of the toner particles to receiving materials, resulting in increase of the lowest fixable temperature of the toner.

The ratio of the particulate resin to the toner particles is preferably from 0.5 to 5.0% by weight. When the content of the particulate resin is too low, the toner has poor preservability. Specifically, a blocking problem in that the toner particles aggregate like a block in a developing device and/or during preservation occurs. In contrast, when the content is too high, the particulate resin prevents the wax included in the toner particles from exuding therefrom. Therefore, the toner has poor releasability, and therefore the offset problem occurs.

In the present application, the content of a particulate resin included in the toner is determined by the method in which the toner is analyzed using a pyrolysis gas chromatograph mass spectrometer to determine the amount of a material or a group specific to the particulate resin by measuring the area of a peak specific to the material or group. A mass spectrometer is preferably used as the detector.

Suitable resins for use as the particulate resins include known resins which can form an aqueous dispersion.

Specific examples thereof include thermoplastic and thermosetting resins such as vinyl resins, polyurethane resins, epoxy resins, polyester resins, polyamide resins, polyimide resins, silicone resins, phenolic resins, melamine resins, urea resins, aniline resins, ionomer resins, polycarbonate resins, etc. These resins can be used alone or in combination.

Among these resins, vinyl resins, polyurethane resins, epoxy resins and polyester resins are preferably used because an aqueous dispersion including fine spherical resin particles can be easily prepared. Specific examples of the vinyl resins include homopolymers or copolymers obtained from one or more vinyl monomers, such as styrene-(meth)acrylate copolymers, styrene-butadiene copolymers, (meth)acrylic acid-acrylate copolymers, styrene-acrylonitrile copolymers, styrene-maleic anhydride copolymers, styrene-(meth)acrylic acid copolymers, etc.

The toner of the present invention is preferably prepared by a method including the following steps of:

reacting a toner composition including a polyester prepolymer with a crosslinking agent and/or a polymer chain extension agent in an aqueous medium to prepare a dispersion including a polyester resin; and adding a fluorine-containing compound to the dispersion to adhere the fluorine-containing compound to the surface of the polyester resin, and/or to bond an ion of a fluorine-containing compound with the surface of the polyester resin.

The thus prepared toner includes, as a binder resin, a polyester resin, with the surface of which the ion is bonded, and has a tensile strength of from 900 to 10000 Pa and a methanol wettability of from 25 to 65% by volume. Therefore the toner has a good combination of developability, transferability, fixability, cleanability and environmental stability.

Then the above-mentioned method for manufacturing the toner will be explained in detail.

At first, the toner composition reacting step will be explained.

A polyester prepolymer is prepared by the following method. A polyol (1) and a polycarboxylic acid are heated to a temperature of from 150 to 280° C. in the presence of an esterification catalyst such as tetrabutoxy titanate and dibutyl tin oxide while generated water is removed, if necessary. Thus, a polyester having a hydroxyl group. Then the polyester resin is reacted with a polyisocyanate (3) to prepare a polyester prepolymer (A) having an isocyanate group.

Then a toner composition including at least the polyester prepolymer (A) is reacted with a crosslinking agent and/or a polymer chain extension agent (such as an amine (B)) in an aqueous medium, resulting in formation of toner particles.

Suitable materials for use as the aqueous medium include water. In addition, solvents which can be mixed with water can be used in combination with water. Specific examples thereof include alcohols such as methanol, isopropanol, and ethylene glycol; dimethylformamide, tetrahydrofuran, cellosolves such as methyl cellosolve, lower ketones such as acetone and methyl ethyl ketone, etc. When the reacting step is performed, a particulate resin can be previously included in the aqueous medium.

In order to prepare an aqueous dispersion in which a polyester prepolymer (A) is stably dispersed, the method in which a toner composition liquid including a solution or dispersion of the polyester prepolymer (A) is added to an aqueous medium and the mixture is dispersed upon application of a shearing force thereto is typically used. Other toner constituents such as colorants, colorant master batches, release agents, charge controlling agents, and unmodified polyester resins can be added to the aqueous medium when the polyester prepolymer (A) is dispersed in the aqueous medium. However, it is preferably that the toner constituents are mixed with the polyester prepolymer (A) and the mixture is dissolved or dispersed in an organic solvent. The resultant solution or dispersion is added to an aqueous medium. The method of adding other toner constituents is not limited to the methods mentioned above, and a method in which other toner constituents are added to toner particles after the toner particles are prepared. For example, a method in which the resultant toner particles are dyed with a colorant using a known dyeing method can be used.

The dispersing operation is not particularly limited, and known mixers and dispersing machines such as low shearing-force type dispersing machines, high shearing-force type dispersing machines, friction type dispersing machines, high pressure jet type dispersing machines and ultrasonic dispersing machine can be used.

When a solution or dispersion of a polyester prepolymer is dispersed in an aqueous medium, it is preferable to prepare an emulsion including particles having an average particle diameter of from 2 to 20 μm. Therefore, high shearing-force type dispersing machines are preferably used.

When high shearing-force type dispersing machines are used, the rotation speed of rotors is not particularly limited, but the rotation speed is generally from 1,000 to 30,000 rpm and preferably from 5,000 to 20,000 rpm. In addition, the dispersing time is also not particularly limited, but the dispersing time is generally from 0.1 to 5 minutes. The temperature in the dispersing process is generally 0 to 150° C. (under pressure), and preferably from 40 to 98° C. The processing temperature is preferably as high as possible because the viscosity of the dispersion decreases and thereby the dispersing operation can be easily performed.

In the emulsification/dispersing process, the weight ratio of the aqueous medium to the toner constituents is generally from 50/100 to 2000/100, and preferably from 100/100 to 1000/100. When the amount of the aqueous medium is too small, the toner constituents cannot be well dispersed, and thereby a toner having a desired particle diameter cannot be prepared. In contrast, to use a large amount of aqueous medium is not economical.

In this dispersion process, a dispersant can be used to stably disperse the resultant toner particles, i.e., to prepare toner particles having a narrow particle diameter distribution.

Suitable dispersants for use in the dispersion process include anionic surfactants such as alkylbenzene sulfonic acid salts, α-olefin sulfonic acid salts, and phosphoric acid salts; cationic surfactants such as amine salts (e.g., alkyl amine salts, aminoalcohol fatty acid derivatives, polyamine fatty acid derivatives and imidazoline), and quaternary ammonium salts (e.g., alkyltrimethyl ammonium salts, dialkyldimethyl ammonium salts, alkyldimethyl benzyl ammonium salts, pyridinium salts, alkyl isoquinolinium salts and benzethonium chloride; nonionic surfactants such as fatty acid amide derivatives and polyhydric alcohol derivatives; and ampholytic surfactants such as alanine, dodecyldi (aminoethyl)glycin, di(octylaminoethyle)glycin, and N-alkyl-N,N-dimethylammonium betaine.

By using a surfactant including a fluoroalkyl group, the effects can be well produced even when the added amount of the surfactant is small.

Specific examples of anionic surfactants having a fluoroalkyl group include fluoroalkyl carboxylic acids having from 2 to 10 carbon atoms and their metal salts, disodium perfluorooctanesulfonylglutamate, sodium 3-{omega-fluoroalkyl (C6-C11)oxy}-1-alkyl(C3-C4) sulfonate, sodium 3-{omega-fluoroalkanoyl(C6-C8)-N-ethylamino}-1-propanesulfonate, fluoroalkyl(C11-C20) carboxylic acids and their metal salts, perfluoroalkylcarboxylic acids and their metal salts, perfluoroalkyl(C4-C12)sulfonate and their metal salts, perfluorooctanesulfonic acid diethanol amides, N-propyl-N-(2-hydroxyethyl)perfluorooctanesulfone amide, perfluoroalkyl(C6-C10)sulfoneamidepropyltrimethylammonium salts, salts of perfluoroalkyl(C6-C10)-N-ethylsulfonyl glycin, monoperfluoroalkyl(C6-C16)ethylphosphates, etc.

Specific examples of the marketed products of such surfactants including a fluoroalkyl group include SARFRON® S-111, S-112 and S-113, which are manufactured by Asahi Glass Co., Ltd.; FLUORAD® FC-93, FC-95, FC-98 and FC-129, which are manufactured by Sumitomo 3M Ltd.; UNIDYNE® DS-101 and DS-102, which are manufactured by Daikin Industries, Ltd.; MEGAFACE® F-110, F-120, F-113, F-191, F-812 and F-833 which are manufactured by Dainippon Ink and Chemicals, Inc.; ECTOP® EF-102, 103, 104, 105, 112, 123A, 306A, 501, 201 and 204, which are manufactured by Tohchem Products Co., Ltd.; FUTARGENT® F-100 and F150 manufactured by Neos; etc.

Specific examples of the cationic surfactants having a fluoroalkyl group include primary, secondary and tertiary aliphatic amino acids having a fluoroalkyl group, perfluoroalkyl (C6-C10)sulfoneamidepropyltrimethylammonium salts, benzalkonium salts, benzetonium chloride, pyridinium salts, imidazolinium salts, etc.

Specific examples of the marketed products thereof include SARFRON® S-121 (from Asahi Glass Co., Ltd.); FLUORAD® FC-135 (from Sumitomo 3M Ltd.); UNIDYNE® DS-202 (from Daikin Industries, Ltd.); MEGAFACE® F-150 and F-824 (from Dainippon Ink and Chemicals, Inc.); ECTOP® EF-132 (from Tohchem Products Co., Ltd.); FUTARGENT® F-300 (from Neos); etc.

Suitable inorganic dispersants which is hardly soluble in water include tricalcium phosphate, calcium carbonate, titanium oxide, colloidal silica, hydroxyapatite, etc.

A polymer protection colloid can be included in the dispersion to stabilize the dispersion.

Suitable polymer protection colloids include homopolymers and copolymers of acids, acrylic monomers having a hydroxyl group, vinyl alcohol and ethers of vinyl alcohol, esters of vinyl alcohol and compounds having a carboxyl group, amides and methylol compounds thereof, chlorides, and monomers having a nitrogen atom; polyoxyethylene compounds; and cellulose compounds.

Specific examples of the acids include acrylic acid, methacrylic acid, α-cyanoacrylic acid, α-cyanomethacrylic acid, itaconic acid, crotonic acid, fumaric acid, maleic acid and maleic anhydride. Specific examples of the acrylic monomers having a hydroxyl group include β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, N-methylolacrylamide and N-methylolmethacrylamide. Specific examples of the vinyl alcohol and its ethers include vinyl methyl ether, vinyl ethyl ether and vinyl propyl ether. Specific examples of the esters of vinyl alcohol with a compound having a carboxyl group include vinyl acetate, vinyl propionate and vinyl butyrate. Specific examples of the acrylic amides include acrylamide, methacrylamide, diacetoneacrylamide and their methylol compounds. Specific examples of the chlorides include acrylic acid chloride and methacrylic acid chloride. Specific examples of the monomers having a nitrogen atom or an alicyclic ring having a nitrogen atom include vinyl pyridine, vinyl pyrrolidone, vinyl imidazole and ethylene imine.

Specific examples of the polyoxyethylene compounds include polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters. Specific examples of the cellulose compounds include methyl cellulose, hydroxyethyl cellulose and hydroxypropyl cellulose.

When a compound soluble in an acid or an alkali, such as calcium phosphate, is used as a dispersion stabilizer, the compound is preferably removed from the toner particles by treating toner particles with an acid such as hydrochloric acid to be dissolved, followed by washing with water. In addition, such a compound can be removed using a zymolytic method.

When a dispersant is used in the dispersion process, the dispersant is preferably removed by being subjected to a washing treatment after the crosslinking reaction and/or molecular chain extension reaction in view of the chargeability of the resultant toner.

The reaction conditions are not particularly limited, and the conditions are determined depending on the reactivity of the prepolymer (A) and the amine (B) used. The reaction time is generally from 10 minutes to 40 hours, and preferably from 2 to 24 hours. The reaction temperature is generally from 0 to 150° C., and preferably from 40 to 98° C.

If desired, known catalysts such as dibutyl tin oxide and dioctyl tin oxide can be used for the reaction.

In order to remove an organic solvent from the thus prepared emulsion/dispersion, a method in which the liquid is gradually heated to perfectly evaporate the organic solvent included therein can be used. Alternatively, a method in which the emulsion/dispersion is sprayed in a dry environment to dry the organic solvent, water and dispersion included therein, resulting in formation of toner particles, can be used.

The dry environment can be formed by heating gases of air, nitrogen, carbon dioxide, combustion gas, etc., preferably, to a temperature not lower than the boiling point of the solvent having the highest boiling point among the solvents used in the emulsion. Toner particles having desired properties can be rapidly prepared by performing this treatment using a spray dryer, a belt dryer, a rotary kiln, etc. Alternatively, the organic solvent can be removed by blowing air into the emulsion/dispersion using a rotary evaporator.

After removal of the organic solvent, the dispersion is subjected to a centrifugal separation treatment to roughly separate the toner particles from water. Then the toner particles are subjected to a washing treatment, followed by drying using a hot air dryer. The washing and drying are repeated several times. Then the toner particles are added to an aqueous liquid including a fluorine-containing compound (which optionally includes a surfactant) to chemically bond the ion of the compound with the surface of the toner particles. Then the toner particles are separated from the aqueous liquid, followed by drying. Thus, a mother toner is prepared.

When the thus prepared mother toner has a wide particle diameter distribution even after the particles are subjected to a washing treatment and a drying treatment, the toner particles are preferably subjected to a classification treatment. When a cyclone, a decanter or a classifier utilizing centrifuge is used, fine particles can be removed. In this case, it is preferable to perform the classification operation in the liquid including the toner particles in view of efficiency. Toner particles having a particle diameter falling out of the predetermined range can be reused for the emulsification/dispersion process. In this case, the fine or coarse particles may be in a dry or wet state. When a dispersion is used, the dispersion is preferably removed from the dispersion, preferably, in a classification process.

The thus prepared toner particles can be mixed with one or more other particulate materials such as colorants, release agents, charge controlling agents, and fluidizers optionally upon application of mechanical impact thereto to fix the particulate materials on the toner particles.

Suitable mechanical impact application methods include methods in which a mixture is mixed with a highly rotated blade and methods in which a mixture is put into a jet air to collide the particles against each other or a collision plate.

Specific examples of such mechanical impact applicators include ONG MILL (manufactured by Hosokawa Micron Co., Ltd.), modified I TYPE MILL in which the pressure of air used for pulverizing is reduced (manufactured by Nippon Pneumatic Mfg. Co., Ltd.), HYBRIDIZATION SYSTEM (manufactured by Nara Machine Co., Ltd.), KRYPTRON SYSTEM (manufactured by Kawasaki Heavy Industries, Ltd.), automatic mortars, etc.

Finally, the toner particles are mixed with an external additive such as particulate inorganic materials (which are preferably hydrophobized) using a mixer such as HENSCHEL MIXER, and then coarse particles are removed using an ultrasonic sieve. Thus, the toner of the present invention is prepared.

Then the process in which an ion of a fluorine-containing compound is bonded with a surface of toner particles (resin particles) in a dispersion of the toner particles will be explained in detail.

Suitable compounds for use as the fluorine-containing compounds to be added to the dispersion include compounds having the following formula (II):

(II)

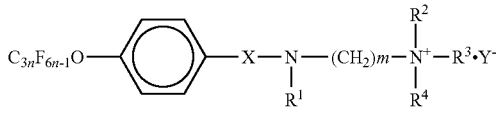

wherein X represents —$SO_2$— or —CO—; each of $R^1$, $R^2$, $R^3$ and $R^4$ represents a hydrogen atom, an alkyl group having from 1 to 10 carbon atoms, or an aryl group having from 6 to 18 carbon atoms; Y represents a halogen such as iodine, bromine and chlorine; and each of m and n is a positive integer.

Specific examples of the alkyl groups having from 1 to 10 carbon atoms include linear and branched alkyl groups having from 1 to 10 carbon atoms such as methyl, ethyl, propyl, isopropyl, butyl, isobutyl, sec-butyl, tert-butyl, (linear or branched) pentyl, (linear or branched) hexyl, (linear or branched) heptyl, (linear or branched) octyl, (linear or branched) nonyl and (linear or branched) decyl groups. Specific examples of the aryl groups having from 6 to 18 carbon atoms include phenyl, 1- or 2-naphthalenyl, 1-, 2- or 9-anthracenyl and 1-, 2-, 3-, 4- or 9-phenanthrenyl groups. Each of m and n is preferably an integer of from 1 to 10. Y is preferably iodine.

Specific examples of the compounds having formula (II) include the following compounds (1) to (27)

(1)

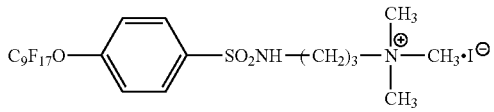

(2)

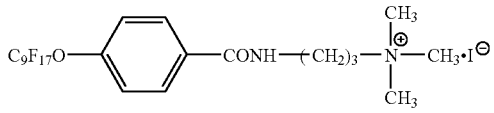

(3)

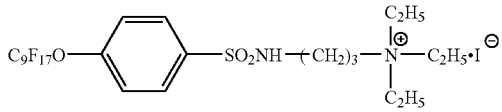

(4)

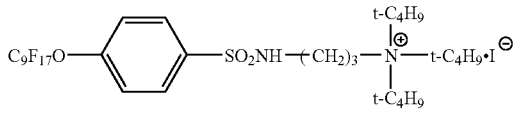

(5)

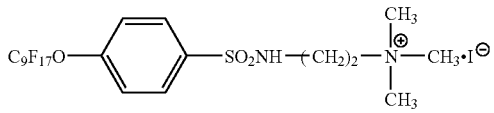

-continued
(6)
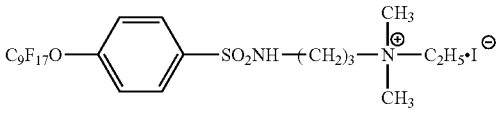
(7)
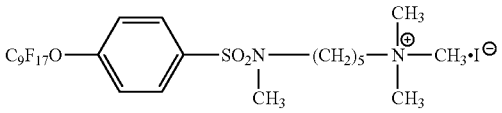
(8)
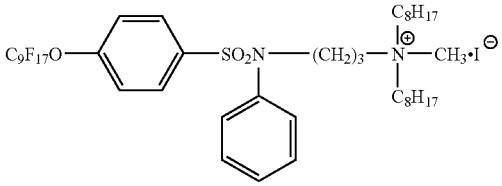
(9)
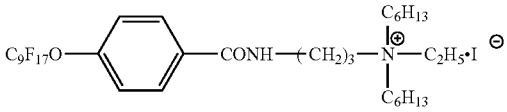
(10)
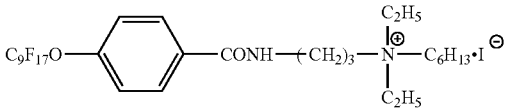
(11)
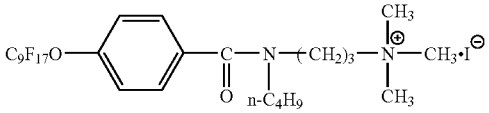
(12)
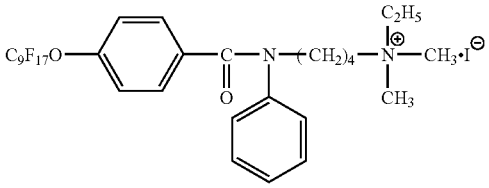
(13)
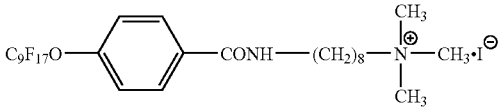
(14)
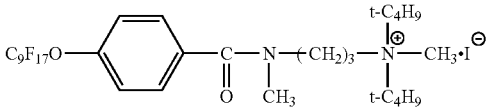
(15)
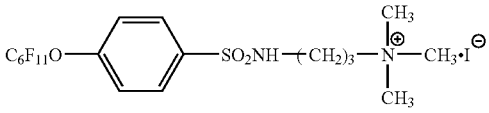
-continued
(16)
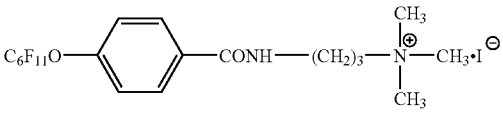
(17)
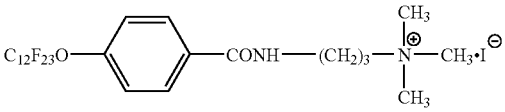
(18)
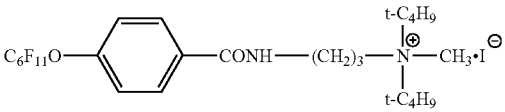
(19)
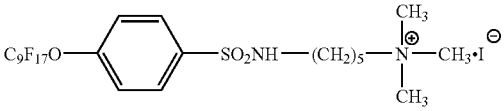
(20)
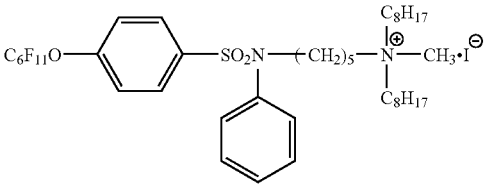
(21)
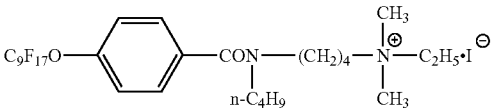
(22)
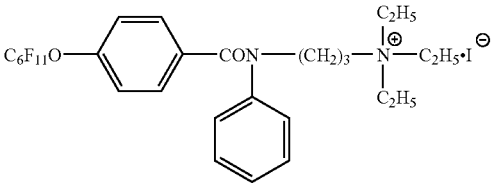
(23)
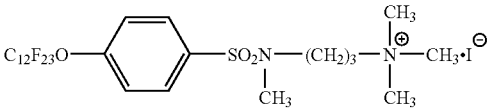
(24)
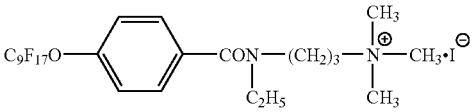
(25)
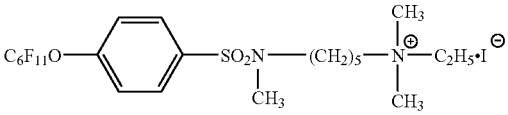

-continued (26)

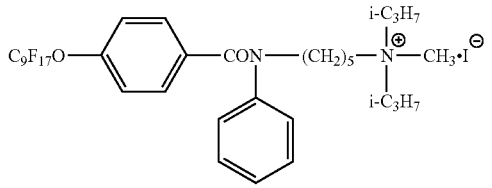

(27)

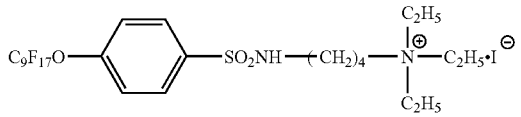

These compounds can be used alone or in combination.

Among the compounds (1) to (27), N,N,N-trimethyl-[3-(perfluorononenyloxybenzamide)propyl]ammonium iodide is preferably used because of imparting good chargeability to the toner. In addition, combinations of these compounds and other fluorine-containing compounds can also be used. The purity, pH, and decomposition temperature of the fluorine containing compounds are not particularly limited.

The added amount of the fluorine-containing compound is preferably from 0.01 to 5% by weight, and more preferably from 0.01 to 3% by weight based on the total weight of the toner. When the added amount is too small, the hydrophobizing effects cannot be well produced. In contrast, when the added amount is too large, a fixing problem in that the toner images cannot be well fixed to receiving materials is caused.

The method for treating the toner surface with such a fluorine-containing compound is typically as follows. The mother toner particles, to which an external additive (such as particulate inorganic materials) is not yet added, are dispersed in an aqueous liquid (preferably including a surfactant) in which a fluorine-containing compound is dispersed so that the fluorine-containing compound is adhered to the toner surface or is connected with the toner surface with an ionic bond. After the solvent is removed from the mixture, the treated toner particles are dried. Thus, toner particles can be prepared. In this case, an alcohol is preferably added to the mixture in an amount of from 5 to 80% by weight, and more preferably from 10 to 50% by weight, to well disperse the fluorine-containing compound, resulting in even adhesion of the compound to the toner surface, and thereby the resultant toner particles have uniform chargeability and non-electrostatic adhesion force.

When a fluorine-containing compound is adhered to or fixed to the toner surface, the following known methods can also be used.

(1) A fluorine-containing compound is adhered and fixed to the toner surface using a mechanical shearing force;

(2) A fluorine-containing compound is mixed with the toner particles upon application of heat thereto;

(3) A fluorine-containing compound is mixed with the toner particles upon application of mechanical impact thereto; and (4) A fluorine-containing compound is bonded with the toner surface by a chemical bond such as covalent bond, hydrogen bond and ionic bond.

When the toner surface is treated with a fluorine-containing compound having formula (II), an anion $Y^-$ is released from the compound and the cation of the compound having a fluorine atom is bonded with the toner surface. Therefore, the counter ion $Y^-$ is not included in the toner. Accordingly, the toner of the present invention can be distinguished from conventional toners by determining whether the anion is present on the surface of toner particles.

Then the developer of the present invention will be explained.

The toner of the present invention can be used as a one component magnetic developer, a one component nonmagnetic toner and for two component developer.

The two component developer of the present invention includes the toner of the present invention and a carrier. By using such a two component developer, full color images having good evenness can be produced.

Suitable materials for use as the carrier include known carrier materials such as iron powders, ferrite powders, magnetite powders, and magnetic resin carriers, which have a particle diameter of from about 20 μm to about 200 μm. The surface of the carriers may be coated with a resin.

Specific examples of such resins to be coated on the carriers include amino resins such as urea-formaldehyde resins, melamine resins, benzoguanamine resins, urea resins, and polyamide resins, and epoxy resins. In addition, vinyl or vinylidene resins such as acrylic resins, polymethylmethacrylate resins, polyacrylonitirile resins, polyvinyl acetate resins, polyvinyl alcohol resins, polyvinyl butyral resins, polystyrene resins, styrene-acrylic copolymers, polyester resins such as polyethyleneterephthalate resins and polybutyleneterephthalate resins, polycarbonate resins, polyethylene resins, halogenated olefin resins such as polyvinyl chloride resins, polyvinyl fluoride resins, polyvinylidene fluoride resins, polytrifluoroethylene resins, polyhexafluoropropylene resins, vinylidenefluoride-acrylate copolymers, vinylidenefluoride-vinylfluoride copolymers, and copolymers of tetrafluoroethylene, vinylidenefluoride and other monomers including no fluorine atom, and silicone resins.

If desired, an electroconductive powder may be included in the coating resin. Specific examples of such electroconductive powders include metal powders, carbon blacks, titanium oxide, tin oxide, and zinc oxide. The average particle diameter of such electroconductive powders is preferably not greater than 1 μm. When the particle diameter is too large, it is hard to control the resistance of the resultant carrier.

The image forming apparatus of the present invention produces images using the toner of the present invention or the developer of the present invention. The image forming apparatus of the present invention will be explained referring to drawings.

FIG. 1 is a schematic view illustrating an embodiment (i.e., a full color image forming apparatus including an intermediate transfer medium and a developing belt) of the image forming apparatus of the present invention.

In FIG. 1, an image forming apparatus 100 includes a photoreceptor drum 10 (hereinafter referred to as a photoreceptor 10) serving as the image bearing member; a charging roller 20 serving as the charging device; a light irradiator 30 serving as the latent image forming device; a developing device 40 serving as the image developing device; an intermediate transfer medium 50; a cleaner 60 serving as the cleaning device and including a cleaning blade; and a discharging lamp 70 serving as the discharging device.

The intermediate transfer medium 50 is an endless belt which is rotated in a direction indicated by an arrow by three rollers 51 arranged therein while tightly stretched by the rollers. At least one of the three rollers 51 applies a transfer bias (first transfer bias) to the intermediate transfer medium 50. A cleaner 90 is provided to clean the surface of the intermediate transfer medium 50.

On the upper side of the intermediate transfer medium 50, a transfer roller 80 is provided which applies a transfer bias (a second transfer bias) to a receiving material 95 on which a toner image is to be transferred. In addition, a corona charger 52 is provided to charge the toner image on the intermediate transfer medium 50 before the toner image is transferred to the receiving material 95.

A developing device 40 includes a black developing unit 45K; a yellow developing unit 45Y; a magenta developing unit 45M; and a cyan developing unit 45C. Each of the developing units includes a developer containing portion 42 (42K, 42Y, 42M or 42C), a developer supplying roller 43 (43K, 43Y, 43M or 43C), and a developing roller 44 (44K, 44Y, 44M or 44C). A thin toner layer is formed on the developing belt 41 by the developer supplying rollers 43 so that an electrostatic latent image on the photoreceptor 10 is developed with the toner layer.

In the image forming apparatus 100, the surface of the photoreceptor 10 is uniformly charged with the charging roller 20. The light irradiator 30 irradiates the charged surface of the photoreceptor 10 with imagewise light-to form an electrostatic latent image on the photoreceptor 10. The developing device 40 develops the latent image with a color toner, which is the toner of the present invention and which is formed as a thin layer on the developing belt 41, to form color toner images on the photoreceptor 10. The thus prepared toner image (or a multi- or full toner image) is transferred to the intermediate transfer medium 50 (first transfer) to form a toner image (e.g., a full color toner image) while at least one of the rollers 51 applies a transfer bias thereto. When a multicolor or full color image is formed, this image forming operation is repeated several times to form a multi-color (or full color) image on the intermediate transfer medium 50. The toner image formed on the intermediate transfer medium 50 is then transferred to the receiving material 95 (second transfer) after the toner image is charged by the corona charger 52. The toner image on the receiving material 95 is fixed by a fixing device (not shown). Toner particles remaining on the photoreceptor 10 are removed with the cleaner 60 and charges remaining on the photoreceptor 10 are removed by irradiating the photoreceptor 10 with light using the discharging lamp 70.

Figure 2:
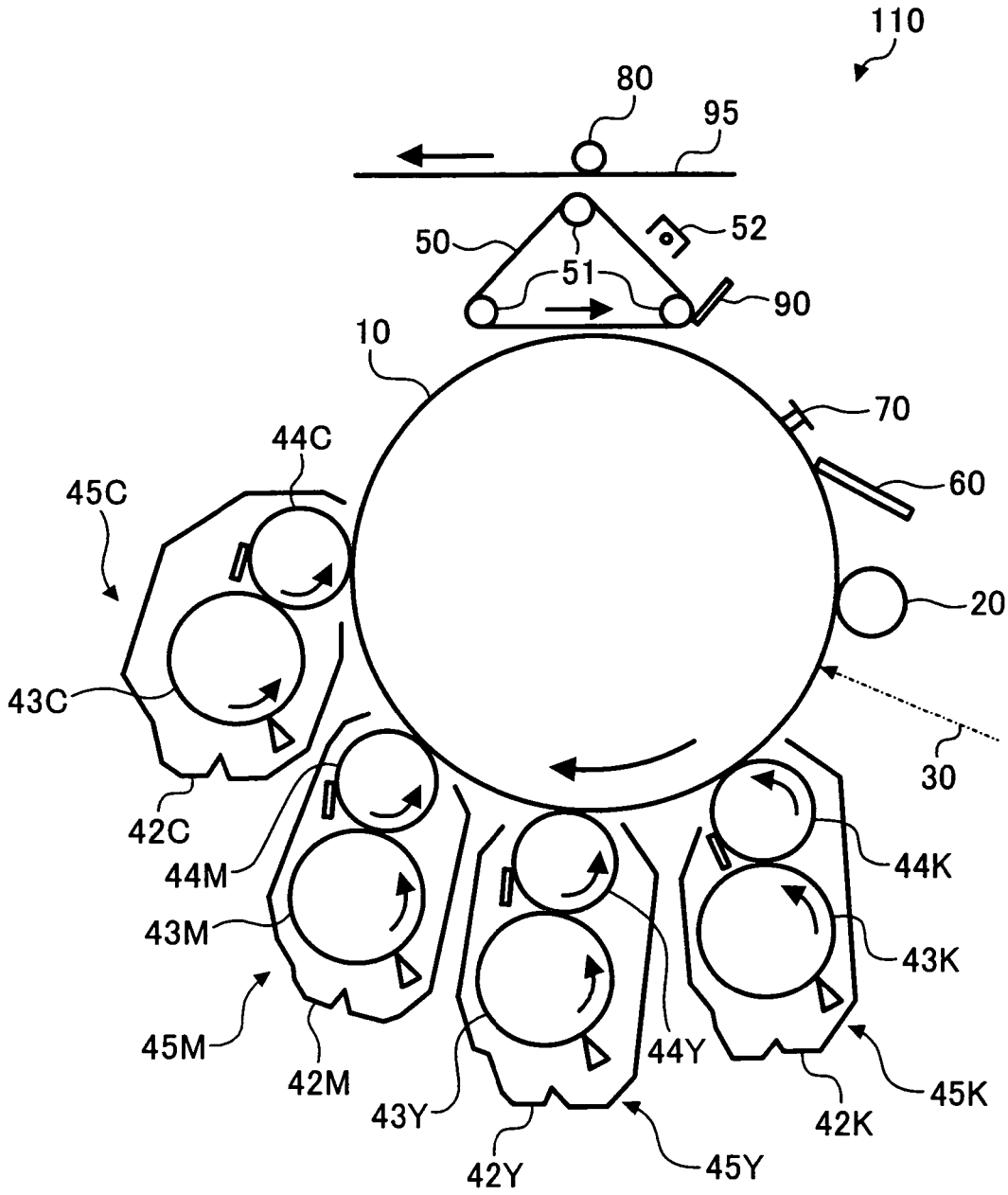
FIG. 2 is a schematic view illustrating another embodiment (i.e., another full color image forming apparatus) of the image forming apparatus of the present invention.

FIG. 2 illustrates another embodiment of the image forming apparatus of the present invention. An image forming apparatus 110 has the same configuration as that of the image forming apparatus illustrated in FIG. 1 except that the black, yellow, magenta and cyan developing units 45K, 45Y, 45M and 45C are directly contacted with the photoreceptor 10 without using the developing belt 41. The action of the image forming apparatus is also the same as that of the image forming apparatus illustrated in FIG. 1.

Figure 3:
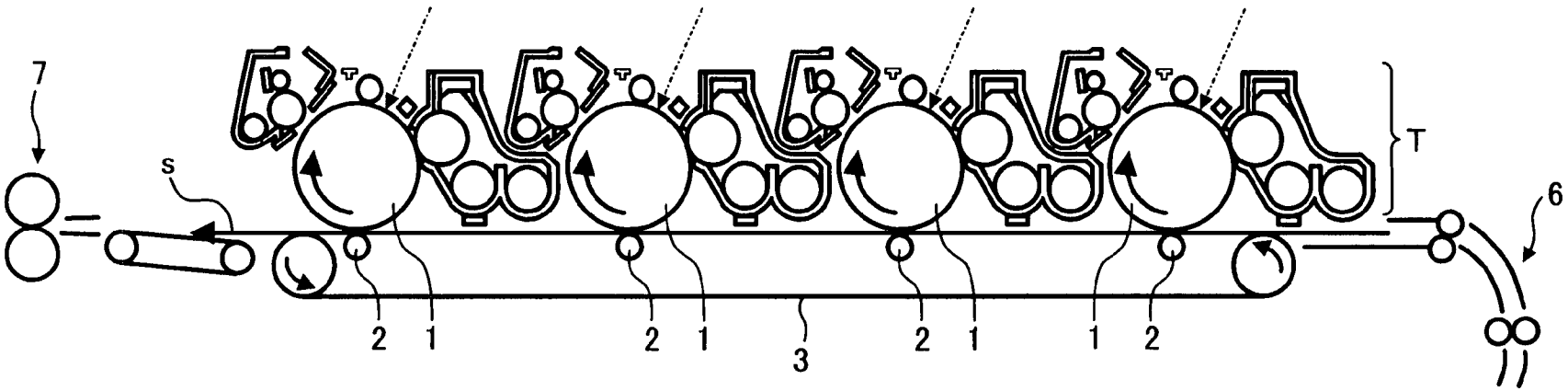
FIG. 3 is a schematic view illustrating yet another embodiment (i.e., a tandem type full color image forming apparatus using a direct image transfer method) of the image forming apparatus of the present invention.

FIG. 3 is a schematic view illustrating another embodiment of the image forming apparatus of the present invention. Specifically, the image forming apparatus is a tandem type full color image forming apparatus using a direct transfer method. The image forming apparatus includes four color image forming units T for forming yellow, magenta, cyan and black toner images. The four color toner images formed by the four units T are directly transferred onto a receiving material fed by a transfer belt to prepare a full color toner image. The tandem type image forming apparatus has the following advantages:

(1) various receiving materials can be used; and (2) high quality images can be produced at a high speed.

In each of the color image forming units T of the image forming apparatus illustrated in FIG. 3, the surface of a photoreceptor 1 is charged with a charger. Then a light irradiator irradiates the charged photoreceptor with imagewise light to form an electrostatic latent image on the surface of the photoreceptor 1. The electrostatic latent image is developed with a color toner to form a color toner image on the surface of the photoreceptor 1. The thus prepared-four color toner images are sequentially transferred directly to a receiving sheet S, which is supplied from a paper supplying device 6 and fed by a sheet feeding belt 3, by a transfer device 2. The thus prepared full color toner image is then fixed to the receiving sheet S by a fixing device 7. Thus a full color image is formed.

Figure 4:
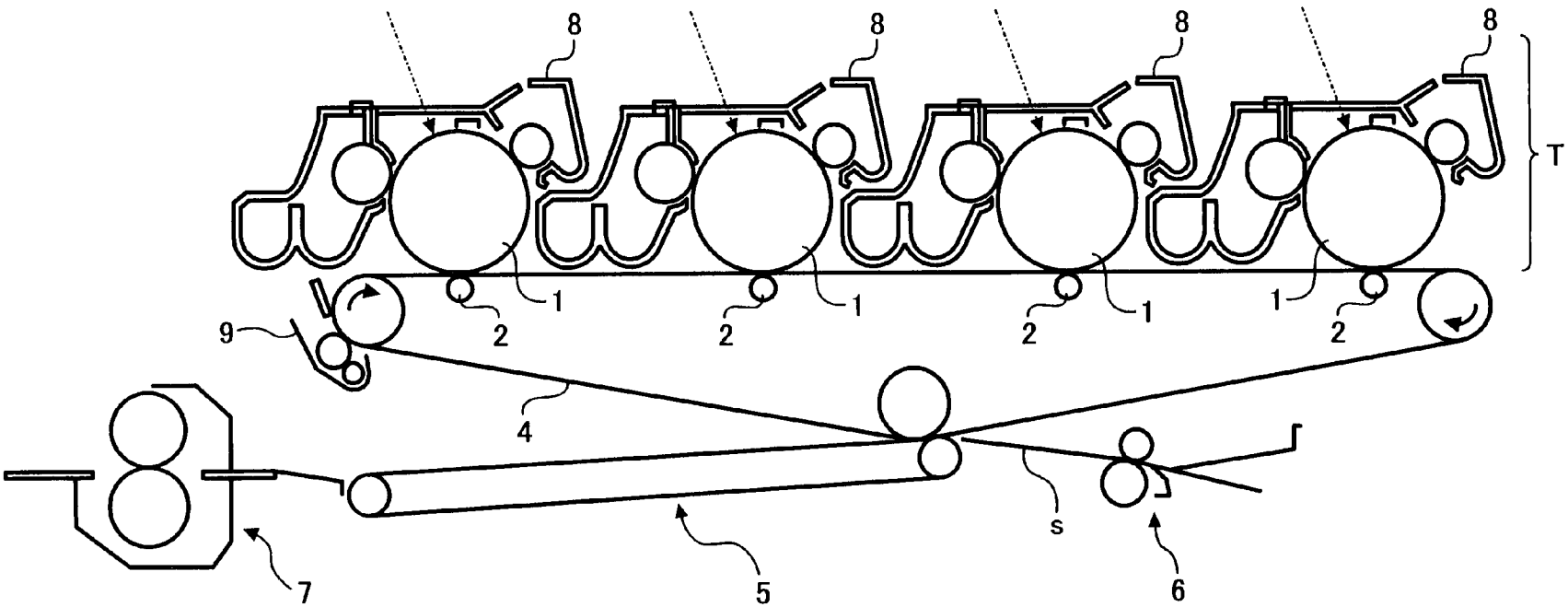
FIG. 4 is a schematic view illustrating yet another embodiment (i.e., a tandem type full color image forming apparatus using an indirect image transfer method) of the image forming apparatus of the present invention.

FIG. 4 is a schematic view illustrating another embodiment of the image forming apparatus of the present invention. Specifically, the image forming apparatus is a tandem type full color image forming apparatus using an indirect transfer method. The image forming apparatus also includes four color image forming units T for forming yellow, magenta, cyan and black toner images. The four color toner images formed by the four units T are transferred onto a receiving material, which is fed by a transfer belt, via an intermediate transfer medium, resulting in formation of a full color image.

In the image forming apparatus illustrated in FIG. 4, four color toner images formed similarly-to the image forming apparatus illustrated in FIG. 3 are sequentially transferred to an intermediate transfer medium 4 by a transfer device 2 serving as a primary transfer device. The toner images formed on the intermediate transfer medium 4 are transferred at the same time to a receiving sheet S, which is supplied by a paper feeding device 6, by a secondary transfer device 5. In FIG. 4, the secondary transfer device 5 has a belt form, but rollers can be used as the secondary transfer device 5.

The thus overlaid color toner images are fixed by a fixing device 7, resulting in formation of a full color image.

In each image forming unit, the surface of the photoreceptor 1 is cleaned with a cleaning device 8 after the toner image is transferred to the intermediate transfer medium 4 so that the photoreceptor is ready for the next image forming operation. In addition, the surface of the intermediate transfer medium 4 is cleaned with a cleaning device 9 after the toner image is transferred to the receiving sheet S so that the intermediate transfer medium 4 is ready for the next image forming operation.

The indirect transfer type image forming apparatus has advantages over the direct transfer type image forming apparatus such that the secondary transfer position can be freely set, and thereby the paper feeding device 6 and the fixing device 7 can be set below the developing devices, resulting in miniaturization of the image forming apparatus; and the fixing device 7 can be set at such a location as not influence the sheet S on the intermediate transfer medium 4, and thereby high quality images can be stably produced.

Suitable photoreceptors for use as the image bearing member of the image forming apparatus of the present invention include amorphous silicon photoreceptors. The photoreceptors can be prepared, for example, by forming an amorphous silicon film, which serves as a photosensitive layer, on an electroconductive substrate heated to a temperature of from 50 to 400° C. by a method such as vapor-phase growth methods, e.g., vacuum vapor deposition methods, sputtering methods, plasma CVD methods, heat CVD methods, light CVD methods, and ion plating methods. Among these methods, a plasma CVD method in which a raw material gas is decomposed by DC, high frequency wave or micro wave glow discharge to deposit amorphous silicon film on a substrate is preferably used.

FIGS. 5A-5D illustrates schematic cross sections of several photoreceptors for use in the image forming apparatus of the present invention.

Figure 5A:
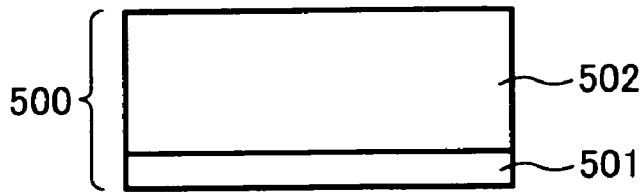
FIGS. 5A-5D are schematic cross sectional views of photoreceptors for use in the image forming apparatus of the present invention.
Figure 5B:
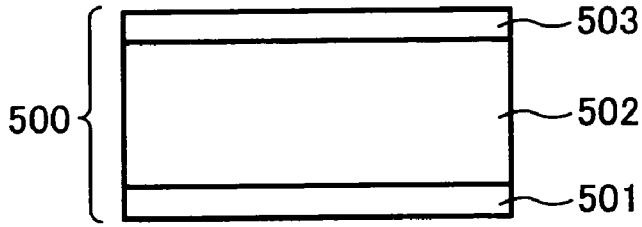

A photoreceptor 500 illustrated in FIG. 5A has a support 501 and a photosensitive layer 502 including amorphous Si:H formed on the support 501. A photoreceptor 500 illustrated in FIG. 5B has a support 501, a photosensitive layer 502 including amorphous Si:H formed on the support 501, and an amorphous silicon based surface layer 503 formed on the photosensitive layer 502.

Figure 5C:
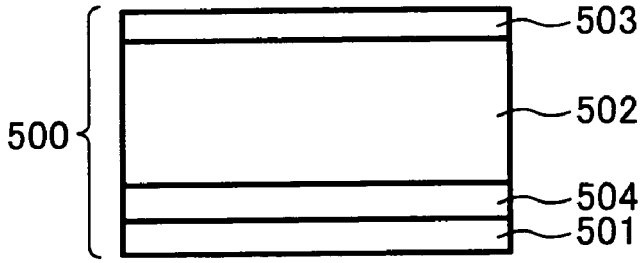
Figure 5D:
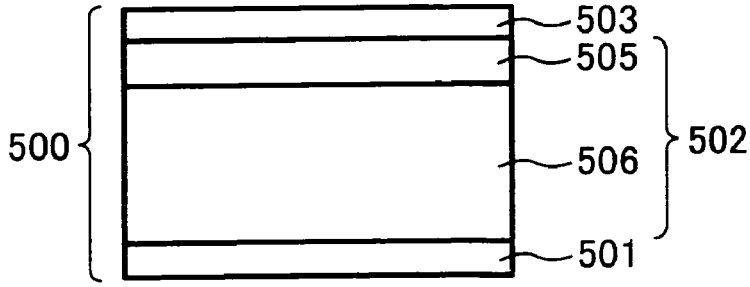

A photoreceptor 500 illustrated in FIG. 5C has a support 501, a photosensitive layer 502 including amorphous Si:H formed on the support 501, an amorphous silicon based surface layer 503 formed on the photosensitive layer 502, and an amorphous silicon based charge injection preventing layer 504 formed on the surface layer 503. A photoreceptor 500 illustrated in FIG. 5D has a support 501, a photosensitive layer 502 including a charge generation layer 505 including amorphous Si:H and a charge transport layer 506, and an amorphous silicon based surface layer 503.

Electroconductive materials and insulating materials can be used as the support of the photoreceptor for use in the present invention. Specific examples of the electroconductive materials for use in the support include metals such as Al, Cr, Mo, Au, In, Nb, Te, V, Ti, Pt, Pd, Fe, etc., and alloys of the metals (e.g., stainless steel). Specific examples of the insulating materials for use in the support include films and sheets of resins such as polyester, polyethylene, polycarbonate, cellulose acetate, polypropylene, polyvinyl chloride, polystyrene, polyamide, etc.; glass, ceramics, etc. An electroconductive layer is preferably formed on at least one side of the films and sheets, on which the photosensitive layer is to be formed.

The support can have a form such as cylindrical forms, sheet forms and endless belt forms, which can have a smooth or rough peripheral surface. The thickness of the support is not particularly limited, and is properly determined such that the resultant photoreceptor can be used for the targeted image forming apparatus without causing any problem. In general, the thickness is preferably not less than 10 μm from the viewpoint of productivity, handling and mechanical strength of the photoreceptor.

The amorphous silicon photoreceptor for use in the present invention preferably has the charge injection preventing layer 504 between the support and the photosensitive layer to prevent injection of charges from the support to the photosensitive layer. Specifically, when the surface of the photoreceptor is charged so as to have a certain polarity, the charge injection preventing layer prevents injection of charges from the support to the photosensitive layer. However, when the photoreceptor is charged so as to have the opposite polarity, the charge injection preventing layer does not function, i.e., the charge injection preventing layer has charge polarity dependence. In order to impart such a property to the charge injection preventing layer, an atom capable of controlling the electroconductivity is added to the layer in a relatively large amount compared to the photosensitive layer.

The thickness of the charge injection preventing layer 504 is determined depending on the targeted electrophotographic properties of the photoreceptor and manufacturing costs, but is generally from 0.1 to 5 μm, preferably from 0.3 to 4 μm, and more preferably from 0.5 to 3 μm.

The photosensitive layer 502 is formed on a support with an optional undercoat layer therebetween. The thickness of the photosensitive layer is determined depending on the targeted electrophotographic properties and manufacturing costs of the photosensitive layer, and is preferably from 1 to 100 μm, more preferably from 20 to 50 μm, and even more preferably from 23 to 45 μm.

The charge transport layer is one layer of functionally separated photosensitive layer having a function of transporting charges. The charge transport layer includes at least a silicon atom, a carbon atom and a fluorine atom, and optionally includes a hydrogen atom and an oxygen atom (i.e., amorphous SiC (H, F, O)). This charge transport layer has a good photoconductive property, i.e., a good combination of charge retaining property, charge generation property and charge transport property. In the photoreceptor for use in the present invention, the charge transport layer preferably includes an oxygen atom.

The thickness of the charge transport layer is determined depending on the targeted electrophotographic properties and manufacturing costs of the layer, and is preferably from 5 to 50 μm, more preferably from 10 to 40 μm, and even more preferably from 20 to 30 μm.

The charge generation layer is one layer of functionally separated photosensitive layer having a function of generating charges. The charge generation layer includes at least a silicon atom, and includes substantially no carbon atom. The layer optionally includes a hydrogen atom. Namely, the charge generation layer includes amorphous Si:H. This charge generation layer has a good photoconductive property, i.e., a good combination of charge generation property and charge transport property.

The thickness of the charge generation layer is determined depending on the targeted electrophotographic properties and manufacturing costs of the layer, and is preferably from 0.5 to 15 μm, more preferably from 1 to 10 μm, and even more preferably from 1 to 5 μm.

An amorphous silicon surface layer is preferably formed on the amorphous silicon photosensitive layer to improve the moisture resistance, electric resistance, environmental stability and durability of the photoreceptor.

The thickness of the surface layer is generally from 0.01 to 3 μm, preferably from 0.05 to 2 μm, and more preferably from 0.1 to 1 μm. If the layer is too thin, the layer tends to be easily abraded when used for a long period of time. When the layer is too thick, the photoreceptor has a high residual potential, and a background development problem in that background area of the resultant images is soiled with toner particles occurs.

The amorphous silicon photoreceptor has the following advantages of:

(1) having a hard surface;

(2) having high sensitivity to semiconductor laser light having a long wavelength ranging from 770 to 800 nm; and (3) having good durability.

Therefore, the photoreceptor can be preferably used for high speed copiers and laser beam printers.

In the image forming apparatus of the present invention, a charger is contacted with the image bearing member (photoreceptor) to apply a voltage thereto and to charge the image bearing member. By using such a contact charger, the amount of ozone generated can be decreased.

Figure 6:
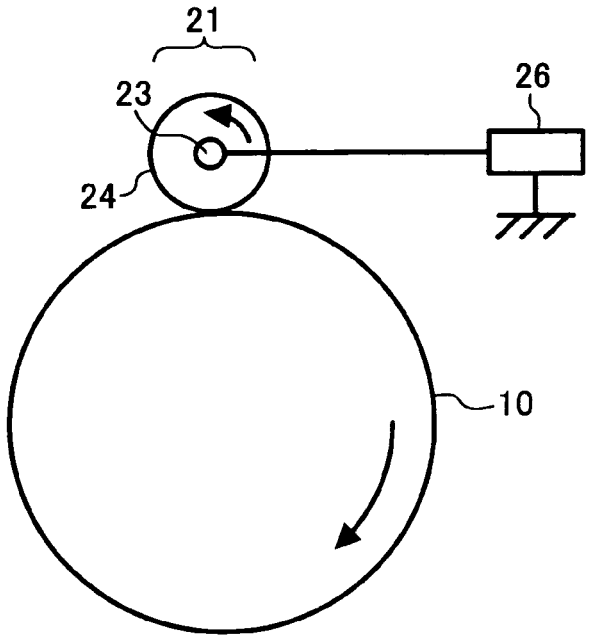
FIGS. 6 and 7 are schematic views illustrating contact charging devices for use in the image forming apparatus of the present invention.

FIG. 6 is a schematic view illustrating another embodiment f the image forming apparatus using a contact charger including a charging roller. In FIG. 6, a photoreceptor 10 which serves as an image bearing member to be charged is rotated at a predetermined speed in a direction indicated by an arrow. A charging roller 21 serving as a contact charging member includes a metal core 23 and an electroconductive rubber layer 24 formed on the metal core 23. The charging roller 21 is rotated by a member such as bearings, which is provided at both ends of the charging roller 21 but is not shown in FIG. 6, while pressed to the photoreceptor 10 at a predetermined pressure by a pressing member (not shown). In this case, the metal core 23 has a diameter of 9 mm and the rubber layer 24 has a medium resistivity of about 100,000Ω·cm and a thickness of 16 mm.

A power source 26 is electrically connected with the metal core 23 to apply a predetermined bias thereto, thereby uniformly charging the surface of the photoreceptor 10. Thus, the peripheral surface of the photoreceptor 10 has a potential having a predetermined polarity.

Figure 7:
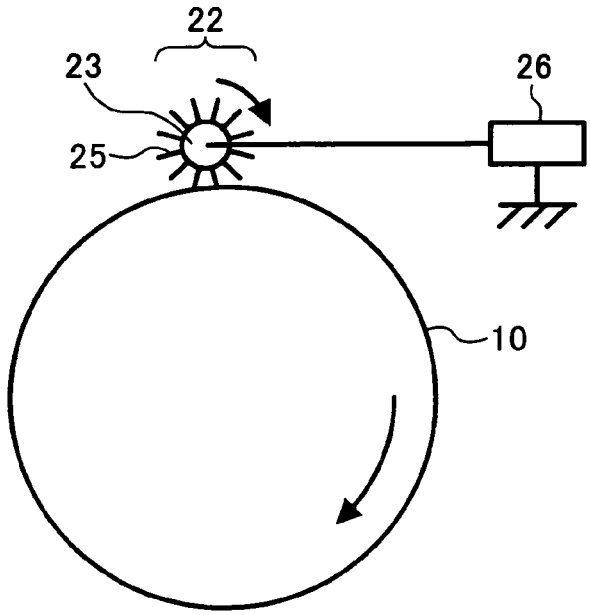

FIG. 7 is a schematic view illustrating another embodiment of the image forming apparatus using a contact charger including a brush roller. In FIG. 7, a photoreceptor 10 which serves as an image bearing member to be charged is rotated at a predetermined speed in a direction indicated by an arrow. A fur brush roller 22 serving as a contact charging member includes a metal core 23 and an electroconductive brush 25 formed on the metal core 23. The brush roller 22 is rotated in a direction indicated by an arrow while pressed to the photoreceptor 10 at a predetermined pressure. A predetermined nip is formed between the brush roller 22 and the photoreceptor 10.

The metal core 23 of the brush roller 22 has a diameter of 6 mm, and the brush 25 is made of an electroconductive rayon fiber REC-B manufactured by Unitika Ltd. Specifically, the brush 25 is prepared by spirally adhering a tape of terry fabric of the rayon fiber to the metal core 23 and has a diameter of 14 mm (i.e., a thickness of 4 mm) and a length of 250 mm. The hair of the brush 25 is constituted of 50 filaments each having a weight of 300 denier. The filaments have a density of 155 lines/mm$^2$. The brush is inserted into a pipe having an inside diameter of 12 mm while rotated in a predetermined direction, followed by aging under high temperature and high humidity conditions to curl the hairs in a predetermined direction.

The resistance of the brush roller 22 is $1\times10^5\Omega$ when measured by the following method.

(1) the brush roller is contacted with a metal drum having a diameter of 30 mm while forming a nip having a width of 3 mm;

(2) a voltage of 100 V is applied to the brush roller and the metal drum to measure the current; and (3) the resistance of the brush is determined by dividing the voltage (100 V) by the current measured.

The resistance of the brush is preferably not lower than $10^4\Omega$ not to cause a defective charging problem in that an excessive current is flown through a pinhole which is undesirably formed on a surface of the photoreceptor, thereby defectively charging the photoreceptor, resulting in formation of undesired images. In addition, the resistance is preferably not higher than $10^7\Omega$ to well charge the photoreceptor.

The following fibers can be used as the brush other than the fiber REC-B from Unitika.

REC-C, REC-M1 and REC-M10, which are manufactured by Unitika Ltd.; SA-7 from Toray Industries Inc.; THUNDERON from Nihon Sanmo Dyeing Co., Ltd.; BELTRON from Kanebo Ltd.; KRACARBO (in which carbon is dispersed in a rayon) from Kuraray Co., Ltd.; ROVAL from Mitsubishi Rayon Co., Ltd.; etc.

The hair is preferably constituted of from 10 to 100 filaments each having a weight of from 3 to 10 denier. The filaments preferably have a density of from 80 to 600 lines/mm$^2$. The length of the hair of the brush is preferably from 1 to 10 mm.

The brush roller 22 is rotated at a predetermined speed in the same direction as that of the photoreceptor 10, i.e., the brush roller counters the photoreceptor at the nip. A predetermined voltage is applied to the brush roller 22 from a power source 26, and thereby the surface of the photoreceptor 10 is uniformly charged so as to have a predetermined potential with a predetermined polarity. In this charging process, the photoreceptor is mainly charged by direct injection charging, and the charged photoreceptor have the same potential which is the same as the voltage applied from the power source.

The charging member is not limited to the above-mentioned members, and other charging members such as magnetic brush rollers can also be used. A proper charging member is selected and used while considering the specifications of the image forming apparatus for which the charging member is used.

Suitable charging members for use as the magnetic brush roller include members in which a particulate ferrite such as Zn—Cu ferrites is used as a magnetic brush is born on a non-magnetic electroconductive sleeve by a magnet roller arranged inside the sleeve.

Brush rollers other than the brush roller 22 mentioned above can also be used. For example, fur brushes in which a fur subjected to an electroconductive treatment using a material such as carbon blacks, copper sulfide, metal and metal oxides is wound around a metal core can also be used.

The image forming apparatus of the present invention preferably has a fixing device which includes a heating member including a heater, a film contacting the heating member, and a pressing member which presses the film toward the heating member, wherein a receiving material having a toner image thereon is fed through the nip between the film and the pressing member.

Figure 8:
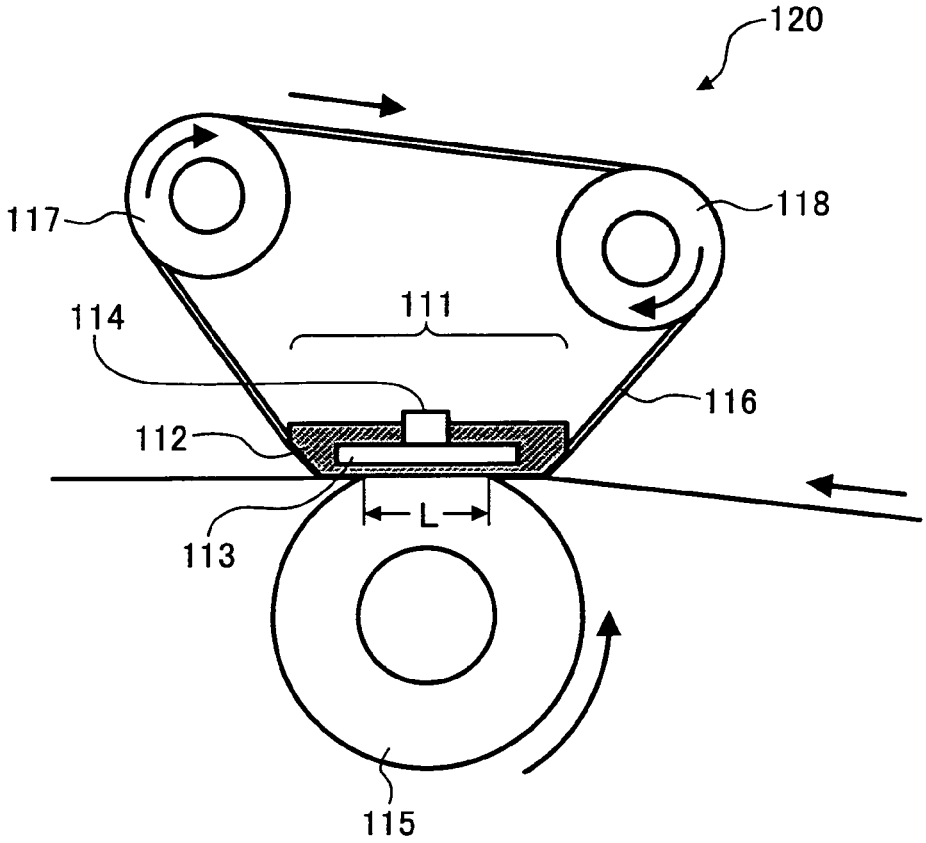
FIG. 8 is a schematic view illustrating a fixing device for use in the image forming apparatus of the present invention.

An example of such a fixing device is illustrated in FIG. 8. In FIG. 8, a fixing device 120 includes a heating member 111 having a plate 112, a heater 113 and a temperature sensor 114; a film 116 which is wound around a driving roller 117, a driven roller 118 and the heating member 111 while rotated by a driving roller 117*a* and a driven roller 118 in a direction indicated by an arrow; and a pressure roller 115 rotating in a direction indicated by an arrow. Character L represents a fixing nip.

The film 116 is an endless heat resistant film, and is rotated while tightly stretched by the driving roller 117, the driven roller 118 and the heating member 111.

The driving roller 117 serves as a tension roller configured to apply a tension to the film 116, and thereby the film 116 is clockwise rotated by the rotation of the driving roller 117. The rotation speed of the film 116 is set so as to be the same as that of the receiving material at the fixing nip L.

The pressure roller 115 has an elastic rubber layer, which is typically made of a rubber having good releasability such as silicone rubbers, on the surface thereof. The pressure roller 115 counterclockwise rotates, and presses the film 116 to the heating member 111 at a pressure of from 4 to 10 kg.

The film is preferably made of a material having a good combination of heat resistance, releasability and durability, and has a total thickness not greater than 100 μm, and more preferably not greater than 40 μm. Specific examples of the film include films of a heat resistant material such as polyimide, polyetherimide, polyether sulfide (PES), and perfluoroethylene-perfluoroalkylvinylether copolymers (PFA). The film may be a multi-layered complex film in which a release layer having a thickness of about 10 μm including a fluoro resin (such as PTFE (polytetrafluoroethylene) and PFA) and an electroconductive material or an elastic layer including a material (such as fluorine-containing rubbers and silicone rubbers) is formed on one side of a film having a thickness of about 20 μm, so that the release layer or the elastic layer contacts the toner images to be fixed.

In the fixing device illustrated in FIG. 8, the heating member includes the plate 112 and heater 113. The plate 112 is made of a material having a high heat conductivity and a high electric resistivity, such as alumina. The heater 113 which includes a resistive heater is included in the surface portion of the plate 112 so as to heat the film 116 while extending in the longitudinal direction of the plate 112. The heater 113 is typically made by forming lines or bands of an electric resistive material such as Ag/Pd and $Ta_2N$ on the plate 112 by a coating method such as screen printing methods.

On both the ends of the heater 113, electrodes (not shown) are provided, through which a voltage is applied to heat the resistive heater. On a side of the plate 112 opposite to that bearing the heater 113, the temperature sensor 114 including a thermistor is provided.

The information on the temperature of the plate 112 which is detected by the temperature sensor 114 is sent to a controller (not shown) and the controller controls the electric power supplied to the heater 113 on the basis of the temperature information to control the temperature of the heater 113. Thus, the temperature of the heating member 111 is controlled so as to be a predetermined temperature.

By using such a fixing device, the warm-up time of the image forming apparatus can be shortened.

Then the process cartridge of the present invention will be explained.

Figure 9:
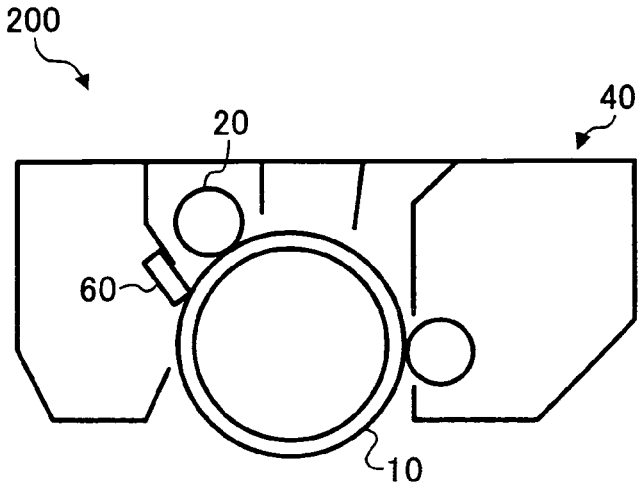
FIG. 9 is a schematic view illustrating an embodiment of the process cartridge of the present invention

FIG. 9 is a schematic view illustrating an embodiment of the process cartridge of the present invention. In FIG. 9, a process cartridge 200 includes a photoreceptor 10, a charging device 20, a developing device 40, and a cleaning device 60. The process cartridge of the present invention is not limited thereto, and any process cartridge including at least a developing device configured to develop an electrostatic latent image with a developer including the toner of the present invention and one or more of an image bearing member such as photoreceptors, a charging device configured to charge the image bearing member and a cleaning device configured to clean the surface of the image bearing member. The process cartridge is detachably set in an image forming apparatus.

In an image forming apparatus having the process cartridge illustrated in FIG. 9, the photoreceptor 10 is rotated at a predetermined rotation speed. The rotated photoreceptor 10 is uniformly charged with the charging device 20 so as to have a predetermined potential with a predetermined polarity. Then the photoreceptor is exposed to imagewise light emitted by a light irradiator such as slit light irradiators and laser beam scanning light irradiators, resulting in formation of an electrostatic latent image on the surface of the photoreceptor 10. The thus formed electrostatic latent image is developed by the developing device 40 using a developer including the toner of the present invention, resulting in formation of a toner image on the photoreceptor 10. The toner image is then transferred onto a receiving material which is timely fed to a transfer section formed by the photoreceptor 10 and a transfer device. The receiving material bearing the toner image thereon is separated from the photoreceptor 10 and is then fed to a fixing device at which the toner image is fixed on the receiving material. The thus prepared copy is discharged from the image forming apparatus. After the image transfer operation, the surface of the photoreceptor 10 is cleaned with the cleaner 60 to remove toner particles from the photoreceptor 10. Then the photoreceptor 10 is discharged so as to be ready for the next image forming operation.

Since the toner of the present invention has a good combination of developability, transferability, fixability, cleanability and environmental stability, high quality images can be stably produced by the process cartridge even after long repeated use and even when environmental conditions are changed.

Then the image forming method of the present invention will be explained.

The image forming method includes at least the following steps:

developing an electrostatic latent image on an image bearing member with the toner of the present invention to form a toner image on the image bearing member; and transferring the toner image onto a receiving material optionally via an intermediate transfer medium.

Since the toner of the present invention has a good combination of developability, transferability, fixability, cleanability and environmental stability, high quality images can be stably produced by the image forming method even after long repeated use and even when environmental conditions are changed.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

Preparation of Particulate Resin Emulsion

In a reaction vessel equipped with a stirrer and a thermometer, 683 parts of water, 11 parts of a sodium salt of sulfate of an ethylene oxide adduct of methacrylic acid (ELEMINOL RS-30 from Sanyo Chemical Industries Ltd.), 166 parts of methacrylic acid, 110 parts of butyl acrylate, and 1 part of ammonium persulfate were mixed. The mixture was agitated for 30 minutes by rotating the stirrer at a revolution of 3,800 rpm. As a result, a milky emulsion was prepared. Then the emulsion was heated at 75° C. for 4 hours to react the monomers. Thus, an aqueous dispersion of a vinyl resin (i.e., a copolymer of methacrylic acid/butyl acrylate/sodium salt of sulfate of ethylene oxide adduct of methacrylic acid) was prepared. This dispersion is hereinafter referred to as a particulate resin dispersion (1).

The volume average particle diameter of the particles in the particulate resin dispersion (1), which was measured with an instrument LA-920 from Horiba Ltd., was 110 nm. In addition, part of the particulate resin dispersion (1) was dried to prepare a solid of the vinyl resin to measure the glass transition temperature and molecular weight. It was confirmed that the vinyl resin has a glass transition temperature of 58° C. and a weight average molecular weight of 130,000.

Preparation of Aqueous Phase Liquid

In a reaction vessel equipped with a stirrer, 990 parts of water, 83 parts of the particulate resin dispersion 1 prepared above, 37 parts of an aqueous solution of a sodium salt of dodecyldiphenyletherdisulfonic acid (ELEMINOL MON-7 from Sanyo Chemical Industries Ltd., solid content of 48.3%), and 90 parts of ethyl acetate were mixed while agitated. As a result, a milky liquid was prepared. This liquid is hereinafter referred to as an aqueous phase liquid (1).

Preparation of Unmodified Polyester Resin

The following components were contained in a reaction container equipped with a condenser, a stirrer and a nitrogen feed pipe.

| | |
|---|---|
| Ethylene oxide (2 mole) adduct of bisphenol A | 229 parts |
| Propylene oxide (3 mole) adduct of bisphenol A | 529 parts |
| Terephthalic acid | 208 parts |
| Adipic acid | 46 parts |
| Dibutyltin oxide | 2 parts |

The mixture was subjected to a polycondensation reaction for 7 hours at 230° C. under normal pressure. Then the reaction was further continued for 5 hours under a reduced pressure of from 10 to 15 mmHg.

Further, 44 parts of trimellitic anhydride were fed to the container to be reacted with the reaction product for 3 hours at 180° C. Thus, an unmodified polyester resin (1) was prepared. The unmodified polyester resin (1) has a number average molecular weight of 2,300, a weight average molecular weight of 6,700, a glass transition temperature (Tg) of 43° C. and an acid value of 25 mgKOH/g.

Synthesis of Intermediate Polyester

The following components were contained in a reaction vessel equipped with a condenser, a stirrer and a nitrogen feed pipe.

| | |
|---|---|
| Ethylene oxide (2 mole) adduct of bisphenol A | .682 parts |
| Propylene oxide (2 mole) adduct of bisphenol A | 81 parts |
| Terephthalic acid | 283 parts |
| Trimellitic anhydride | 22 parts |
| Dibutyl tin oxide | 2 parts |

The mixture was reacted for 7 hours at 230° C. under normal pressure. Then the reaction was further continued for 5 hours under a reduced pressure of from 10 to 15 mmHg. Thus, an intermediate polyester resin 1 was prepared. The intermediate polyester 1 has a number average molecular weight of 2,200, a weight average molecular weight of 9,700, a glass transition temperature (Tg) of 54° C., an acid value of 0.5 mgKOH/g and a hydroxyl value of 52 mgKOH/g.

In a reaction vessel equipped with a condenser, a stirrer and a nitrogen feed pipe, 410 parts of the intermediate polyester resin (1), 89 parts of isophorone diisocyanate and 500 parts of ethyl acetate were mixed. The mixture was heated at 100° C. for 5 hours to perform the reaction. Thus, a polyester prepolymer (1) having an isocyanate group was prepared. The content of free isocyanate included in the polyester prepolymer (1) was 1.53% by weight.

Synthesis of Ketimine Compound

In a reaction vessel equipped with a stirrer and a thermometer, 170 parts of isophorone diamine and 75 parts of methyl ethyl ketone were mixed and reacted for 4.5 hours at 50° C. to prepare a ketimine compound. The ketimine compound has an amine value of 417 mgKOH/g.

Preparation of Master Batch

The following components were mixed using a HENSCHEL MIXER from Mitsui Mining Co., Ltd.

| | |
|---|---|
| Water | 600 parts |
| Pigment Blue 15:3 (wet cake having a solid content of 50%) | 1200 parts |
| Polyester resin | 1200 parts |

The mixture was kneaded for 45 minutes at 120° C. using a two roll mill. Then the kneaded mixture was cooled by rolling, followed by pulverizing. Thus, a master batch (1) was prepared.

Preparation of Oil Phase Liquid

In a reaction vessel equipped with a stirrer and a thermometer, 378 parts of the unmodified polyester resin (1), 100 parts of carnauba wax, and 947 parts of ethyl acetate were mixed and the mixture was heated to 80° C. while agitated. After the mixture was heated at 80° C. for 5 hours, the mixture was cooled to 30° C. over 1 hour. Then 500 parts of the master batch (1) and 500 parts of ethyl acetate were added to the vessel, and the mixture was agitated for 1 hour to prepare a raw material dispersion (1).

Then 1324 parts of the raw material dispersion (1) were subjected to a dispersion treatment using a bead mill (ULTRAVISCOMILL from Aimex Co., Ltd.). The dispersing conditions were as follows.

Liquid feeding speed: 1 kg/hour

Peripheral speed of disc: 6 m/sec

Dispersion media: zirconia beads with a diameter of 0.5 mm

Filling factor of beads: 80% by volume

Repeat number of dispersing operation: 3 times (3 passes)

Then 1324 parts of 65% ethyl acetate solution of the unmodified polyester resin (1) prepared above were added thereto. The mixture was subjected to the dispersion treatment using the bead mill. The dispersion conditions are the same as those mentioned above except that the dispersion operation was performed twice (i.e., two passes).

The thus prepared colorant/wax dispersion (1) had a solid content of 50% when it was determined by heating the liquid at 130° C. for 30 minutes.

Emulsification and Solvent Removal

Then the following components were mixed in a vessel.

| | |
|---|---|
| Colorant/wax dispersion (1) prepared above | 749 parts |
| Polyester prepolymer (1) prepared above | 115 parts |
| Ketimine compound (1) prepared above | 2.9 parts |

The components were mixed for 1 minute using a TK HOMOMIXER from Tokushu Kika Kogyo K.K., which was rotated at a revolution of 5,000 rpm. Thus, an oil phase liquid (1) (i.e., a toner composition liquid) was prepared.

In a container, 1,200 parts of the aqueous phase liquid (1) and 866.9 parts of the oil phase liquid (1) prepared above were mixed and the mixture was mixed for 25 minutes using TK HOMOMIXER at a revolution of 13,000 rpm. Thus, an emulsion (1) was prepared.

The thus prepared emulsion (1) was fed into a container equipped with a stirrer having paddles and a thermometer, and the emulsion was heated for 8 hours at 30° C. to remove the organic solvent (ethyl acetate) from the emulsion. Then the emulsion was aged for 7 hours at 45° C. Thus, a dispersion (1) was prepared.

Washing and Drying

One hundred (100) parts of the dispersion (1) were filtered under a reduced pressure.

Then the wet cake was mixed with 100 parts of ion-exchange water and the mixture was agitated for 10 minutes with a TK HOMOMIXER, which was rotated at a revolution of 12,000 rpm, followed by filtering. Thus, a wet cake (a) was prepared.

The thus prepared wet cake (a) was mixed with 100 parts of a 10% aqueous solution of sodium hydroxide and the mixture was agitated for 10 minutes with a TK HOMOMIXER, which was rotated at a revolution of 12,000 rpm, followed by filtering under a reduced pressure. Thus, a wet cake (b) was prepared.

The thus prepared wet cake (b) was mixed with 100 parts of a 10% hydrochloric acid and the mixture was agitated for 10 minutes with a TK HOMOMIXER, which was rotated at a revolution of 12,000 rpm, followed by filtering. Thus, a wet cake (c) was prepared.

Then the wet cake (c) was mixed with 300 parts of ion-exchange water and the mixture was agitated for 10 minutes with a TK HOMOMIXER, which was rotated at a revolution of 12,000 rpm, followed by filtering. This operation was repeated twice. Thus, a wet cake (1) was prepared.

The wet cake (1) was dried for 48 hours at 45° C. using a circulating air drier.

Thus, a mother toner (1) were prepared.

Adhesion of Fluorine-Containing Compound

The thus prepared mother toner (1) was added to a 1% aqueous solution of the fluorine containing compound (2) having the following formula.

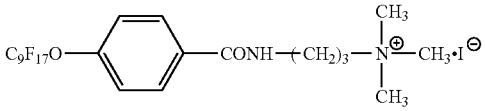

(2)

In this case, the weight ratio ((2)/MT) of the fluorine-containing compound (2) to the mother toner (MT) is 0.1/100 by weight.

The thus prepared mother toner, whose surface had been treated with the fluorine-containing compound (2), was dried for 48 hours at 45° C., followed by drying at 30° C. for 10 hours. Then the mother toner was sieved using a mesh having openings of 75 μm. Thus, a treated mother toner (1) was prepared.

Addition of External Additive

The following components were mixed using a HENSCHEL MIXER.

| | |
|---|---|
| Treated mother toner (1) | 100 parts |
| Hydrophobized silica (1) (silica treated with hexamethyldisilazane using a combustion, average primary particle diameter of 10 nm) | 1.5 parts |
| Hydrophobized silica (2) (silica treated with hexamethyldisilazane using a sol-gel method, average primary particle diameter of 120 m) | 1 part |
| Hydrophobized titanium oxide | 0.5 parts |

(silica treated with hexamethyldisilazane using a combustion method, average primary particle diameter of 10 nm)

| | |
|---|---|
| Hydrophobized silica (2) | 1 part |

(silica treated with hexamethyldisilazane using a sol-gel method, average primary particle diameter of 120 nm)

| | |
|---|---|
| Hydrophobized titanium oxide | 0.5 parts |

Thus, a toner of Example 1 was prepared. The physical properties and evaluation results of the toner are shown in Tables 1 to 3.

Example 2

The procedure for preparation of the toner in Example 1 was repeated except that the fluorine-containing compound (2) was replaced with the fluorine-containing compound (1) having the following formula.

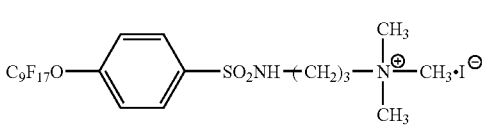

(1)

Example 3

The procedure for preparation of the toner in Example 1 was repeated except that the weight ratio ((2)/MT) of the fluorine-containing compound (2) to the mother toner (MT) is 0.3/100 by weight.

Example 4

The procedure for preparation of the toner in Example 1 was repeated except that methanol was added to the 1% aqueous solution of the fluorine containing compound (2) in an amount of 50% by weight.

Example 5

First Process (Preparation of Particulate Resin Dispersion (2))

The following components were mixed.

| | |
|---|---|
| Styrene | 370 g |
| n-Butyl acrylate | 30 g |
| Acrylic acid | 8 g |
| Dodecane thiol | 24 g |
| Carbon tetrabromide | 4 g |

The mixture was added to an aqueous medium which was prepared by dissolving 6 g of a nonionic surfactant (NONIPOL 400 from Sanyo Chemical Industries Ltd.) and 10 g of an anionic surfactant (NEOGEN SC from Dai-ichi Kogyo Seiyaku Co., Ltd.) in 550 g of ion-exchange water. The mixture was dispersed in a flask to prepare an emulsion. After the emulsion was agitated slowly for 10 minutes, an aqueous solution of ammonium persulfate in which 3 g of ammonium persulfate is dissolved in 50 g of ion-exchange water was added to the emulsion. After the air inside the flask was replaced with nitrogen, the mixture was heated to 70° C. in an oil bath while agitated to perform an emulsion reaction. The emulsion reaction was performed for 5 hours. As a result, a particulate resin dispersion (2) in which a particulate resin having an average particle diameter of 155 nm, a glass transition temperature of 59° C., and a weight average molecular weight (Mw) of 12,000 was prepared.

(Preparation of Particulate Resin Dispersion (3))

The following components were mixed.

| | |
|---|---|
| Styrene | 280 g |
| n-Butyl acrylate | 120 g |
| Acrylic acid | 8 g |

The mixture was added to an aqueous medium which was prepared by dissolving 6 g of a nonionic surfactant (NONIPOL 400 from Sanyo Chemical Industries Ltd.) and 12 g of an anionic surfactant (NEOGEN SC from Dai-ichi Kogyo Seiyaku Co., Ltd.) in 550 g of ion-exchange water. The mixture was dispersed in a flask to prepare an emulsion. After the emulsion was agitated slowly for 10 minutes, an aqueous solution of ammonium persulfate in which 3 g of ammonium persulfate is dissolved in 50 g of ion-exchange water was added to the emulsion. After the air inside the flask was replaced with nitrogen, the mixture was heated to 70° C. in an oil bath while agitated to perform an emulsion reaction. The emulsion reaction was performed for 5 hours. As a result, a particulate resin dispersion (3) in which a particulate resin having an average particle diameter of 105 um, a glass transition temperature of 53° C., and a weight average molecular weight (Mw) of 550,000 was prepared.

(Preparation of Colorant Dispersion (1))

The following components were mixed.

| | |
|---|---|
| Carbon black (MOGUL L from Cabot Corp.) | 50 g |
| Nonionic surfactant (NONIPOL 400 from Sanyo Chemical Industries Ltd.) | 5 g |
| Ion exchange water | 200 g |

The mixture was subjected to a dispersion treatment for 10 minutes using a homogenizer (ULTRA-TURRAX T50 from IKA Japan). Thus, a colorant dispersion (1) including the colorant (carbon black) having an average particle diameter of 250 nm was prepared.

(Preparation of Release Agent Dispersion (1))

The following components were mixed and then heated to 95° C.

| | |
|---|---|
| Paraffin wax (HNP0190 from NIPPON SEIRO CO., LTD., melting point of 85° C.) | 50 g |
| Cationic surfactant (SANIZOL B50 from Kao Corp.) | 5 g |
| Ion exchange water | 200 g |

The mixture was subjected to a dispersion treatment for 10 minutes using a homogenizer (ULTRA-TURRAX T50 from IKA Japan), followed by second dispersion treatment using a pressure homogenizer. Thus, a release agent dispersion (1) including the release agent (paraffin wax) having an average particle diameter of 550 nm was prepared.

(Preparation of Agglomerated Particles)

The following components were mixed in a round flask made of a stainless steel.

| | |
|---|---|
| Particulate resin dispersion (2) | 120 g |
| Particulate resin dispersion (3) | 80 g |
| Colorant dispersion (1) | 30 g |
| Release agent dispersion (1) | 40 g |
| Cationic surfactant (SANIZOL B50 from Kao Corp.) | 1.5 g |

The mixture was subjected to a dispersion treatment for 10 minutes using a homogenizer (ULTRA-TURRAX T50 from IKA Japan). Then the mixture was heated to 48° C. in an oil bath. After being allowed to settle at 48° C. for 30 minutes, the mixture was observed with an optical microscope. It was confirmed that the dispersion has agglomerated particles having an average particle diameter of about 5 μm and the total volume of the agglomerated particles is 95 $cm^3$.

Second Process (Preparation of Complex Particles)

Sixty (60) grams of the particulate resin dispersion (2) was gradually added to the dispersion prepared in the first process. In this case, the total volume of the particulate resin included in the particulate resin dispersion (2) was 25 $cm^3$. Then the mixture was heated to 50° C. in an oil bath and was allowed to settle at 50° C. for 1 hour.

Third Process

Then 3 g of an anionic surfactant (NEOGEN SC from Dai-ichi Kogyo Seiyaku Co., Ltd.) was added to the mixture prepared in the second process. After the stainless flask was sealed, the mixture was heated to 105° C. for 3 hours while agitated and magnetically sealed.

After the mixture was cooled, the mixture was filtered to obtain the reaction product. Then the reaction product (particles) was washed with ion-exchange water, followed by drying.

Fourth Process

Then the surface of the reaction product was treated with the fluorine-containing compound (2) in an aqueous medium such that the weight ratio ((2)/P) of the fluorine-containing compound (2) to the reaction product (P) is 0.09/100. Then the treated reaction product was dried for 48 hours at 45° C. using a circulating air dryer, followed by sieving using a mesh having openings of 75 μm. Thus, a treated mother toner (2) was prepared.

Fifth Process

The following components were mixed using a HENSCHEL MIXER.

| | |
|---|---|
| Treated mother toner (2) | 100 parts |
| Hydrophobized silica (1) (silica treated with hexamethyldisilazane using a combustion method, average primary particle diameter of 10 nm) | 1.5 parts |
| Hydrophobized silica (2) (silica treated with hexamethyldisilazane using a sol-gel method, average primary particle diameter of 120 nm) | 1 part |
| Hydrophobized titanium oxide | 0.5 parts |

(silica treated with hexamethyldisilazane using a' combustion method, average primary particle diameter of 10 nm)

| | |
|---|---|
| Hydrophobized silica (2) | 1 part |

(silica treated with hexamethyldisilazane using a sol-gel method, average primary particle diameter of 120 nm)

| | |
|---|---|
| Hydrophobized titanium oxide | 0.5 parts |

Thus, a toner of Example 5 was prepared. The physical properties and evaluation results of the toner are shown in Tables 1 to 3.

Example 6

Preparation of Modified Polyester Resin

The following components were contained in a reaction vessel equipped with a condenser, a stirrer and a nitrogen introducing tube.

| | |
|---|---|
| Ethylene oxide adduct (2 mole) of bisphenol A | 724 parts |
| Isophthalic acid | 276 parts |
| Dibutyl tin oxide | 2 parts |

Then the mixture was reacted for 8 hours at 230° C. under normal pressure.

Then the reaction was further continued for 5 hours under a reduced pressure of from 10 to 15 mmHg, followed by cooling to 160° C. Then the reaction product was mixed with 32 parts of phthalic anhydride and the mixture was reacted for 2 hours.

After being cooled to 80° C., the reaction product was further reacted with 188 parts of isophorone diisocyanate in ethyl acetate for 2 hours. Thus, a polyester prepolymer (2) having an isocyanate group was prepared.

Then the following components were reacted for 2 hours at 50° C.

| | |
|---|---|
| Polyester prepolymer (2) | 267 parts |
| Isophorone diamine | 14 parts |

Thus, a urea-modified polyester resin (2) having a weight average molecular weight of 64,000 was prepared.

Preparation of Unmodified Polyester Resin

The following components were contained in a reaction container equipped with a condenser, a stirrer and a nitrogen feed pipe.

| | |
|---|---|
| Ethylene oxide adduct (2 mole) of bisphenol A | 724 parts |
| Terephthalic acid | 138 parts |
| Isophthalic acid | 138 parts |

The mixture was subjected to a polycondensation reaction for 6 hours at 230° C. under normal pressure. Then the reaction was further continued for 5 hours under a reduced pressure of from 10 to 15 mmHg. Thus, an unmodified polyester resin (2) having a peak molecular weight of 2,300, a hydroxyl value of 55 mgKOH/g, and an acid value of 1 mgKOH/g was prepared.

Then 200 parts of the urea-modified polyester resin (2) and 800 parts of the unmodified polyester resin (2) were dissolved in 1000 parts of a mixture solvent in which ethyl acetate and methyl ethyl ketone is mixed in a ratio of 1/1 to prepare a binder solution (1).

In a reaction vessel equipped with a condenser, an agitator and a thermometer, the following components were mixed.

| | |
|---|---|
| Water | 942 parts |
| 10% suspension of hydroxyapatite (SUPERTITE 10 from Nippon Chemical Industrial Co., Ltd.) | 58 parts |

(SUPERTITE 10 from Nippon Chemical Industrial Co., Ltd.)

Then 1,000 parts of the binder solution (1) was added thereto and the mixture was agitated. The mixture was heated to 98° C. to remove the organic solvent therein, resulting in preparation of a dispersion. After being cooled, the dispersion was filtered. The thus obtained particles were then washed and dried. Thus, a toner binder (1) having a glass transition temperature (Tg) of 52° C., a Tη of 123° C., and a TG' of 132° C. was prepared.

Then the following components were mixed using a HENSCHEL MIXER (FM10B from Mitsui Miike Machinery Co., Ltd.).

| | |
|---|---|
| Toner binder (1) prepared above | 100 parts |
| Glycerin tribehenate | 7 parts |
| CYANINE BLUE KRO (from SANYO COLOR WORKS, LTD.) | 4 parts |

(from SANYO COLOR WORKDS, LTD.)

The mixture was then kneaded with a two-axis kneader (PCM30 from Ikegai Corporation. Further, the kneaded material was pulverized with an ultrasonic jet air pulverizer (LABJET from Nippon Pneumatic Mfg. Co., Ltd.), followed by classification using an air classifier (MSD-I from Nippon Pneumatic Mfg. Co., Ltd.).

Then the thus prepared particles were added to an aqueous medium including the fluorine-containing compound (2) such that the surface of the particles is treated with the fluorine-containing compound (2). Then the treated particles were dried for 48 hours at 45° C. in a circulating air dryer, followed by sieving using a mesh having openings of 75 μm. Thus, a treated mother toner (3) was prepared.

The following components were mixed using a HENSCHEL MIXER.

| | |
|---|---|
| Treated mother toner (3) | 100 parts |
| Hydrophobized silica (1) (silica treated with hexamethyldisilazane using a combustion method, average primary particle diameter of 10 nm) | 1.5 parts |
| Hydrophobized silica (2) (silica treated with hexamethyldisilazane using a sol-gel method, average primary particle diameter of 120 nm) | 1 part |
| Hydrophobized titanium oxide | 0.5 parts |

Thus, a toner of Example 6 was prepared. The physical properties and evaluation results of the toner are shown in Tables 1 to 3.

Example 7

Preparation of Polyol Resin

The following components were mixed in a separable flask equipped with an agitator, a thermometer, a nitrogen feeding pipe and a condenser.

| | |
|---|---|
| Bisphenol A form epoxy resin 1 (number average molecular weight of about 360) | 378.4 g |
| Bisphenol A form epoxy resin 2 (number average molecular weight of about 2,700) | 86.0 g |
| Diglycidyl compound of propylene oxide adduct of bisphenol A | 191.0 g |
| Bisphenol F | 274.5 g |
| p-Cumyl phenol | 70.1 g |
| Xylene | 200 g |

The mixture was heated to a temperature of from 70 to 100° C. under a nitrogen gas flow, and 0.183 g of lithium chloride was added thereto. The mixture was heated to 160° C. and water was added thereto under a reduced pressure to bubble water and xylene, i.e., to evaporate water, xylene, other volatile components and components soluble in the polar solvents. Then the mixture was polymerized for 6 to 9 hours at 180° C. Thus, 1,000 g of a polyol resin (1) having a number average molecular weight of 3800, a ratio (Mw/Nm) of 3.9, a Mp of 5000, a softening point of 109° C., a glass transition temperature (Tg) of 58° C. and an epoxy equivalent not lower than 20,000 was prepared. In this regard, the reaction conditions were controlled so that the monomers remain even after the polymerization reaction. In addition, it was confirmed that the polyol resin has a polyoxyalkylene moiety in the main chain thereof.

Preparation of Toner

The following components were mixed with a HENSCHEL MIXER.

| | |
|---|---|
| Water | 600 parts |
| Wet cake of Pigment Yellow 17 (solid content of 50%) | 1,200 parts |
| Polyol resin (1) | 1,200 parts |

Thus a mixture in which water is invaded into the agglomerated pigment was prepared. Then the mixture was kneaded at 110° C. for 30 minutes using a two-roll mill. After being subjected to roll cooling, the kneaded mixture was pulverized with a pulverizer. Thus a yellow pigment master batch was prepared.

Then the following components were mixed.

| | |
|---|---|
| Polyol resin (1) prepared above | 100 parts |
| Yellow pigment master batch prepared above | 8 parts |
| Charge controlling agent (BONTRON E-84 from Orient Chemical Industries Co., Ltd.) | 1.5 parts |
| Fatty acid ester wax (melting point of 83° C., melt viscosity of 280 mPa · s at 90° C.) | 5 parts |

(melting point of 83° C., melt viscosity of 280 mPa·s at 90° C.)

The mixture was mixed by a mixer and then melted and kneaded twice using a two-roll mill. Then the mixture was cooled by rolling. The mixture was pulverized with a pulverizer (I TYPE MILL manufactured by Nippon Pneumatic Mfg. Co., Ltd.) which is a jet mill using a collision plate. Then the pulverized mixture was air-classified by a classifier (DS CLASSIFIER manufactured by Nippon Pneumatic Mfg. Co., Ltd.) which uses circling air. Thus, a particulate color material was prepared.

Then 100 parts of the thus prepared particulate color material was mixed with 0.5 parts of the fluorine-containing compound (2) using a Q-form mixer to fix the fluorine-containing compound (2) on the surface of the particulate color material. Then the particulate color material was sieved using a mesh having openings of 75 μm. Thus, a treated mother toner (4) was prepared.

Then 100 parts of the treated mother toner (4) was mixed with 1 part of a hydrophobized silica having a particle diameter of 10 nm using a HENSCEL MIXER. Thus, a toner of Example 7 was prepared. The physical properties and evaluation results of the toner are shown in Tables 1 to 3.

Comparative Example 1

The procedure for preparation of the toner in Example 1 was repeated except that the treatment using the fluorine-containing compound (2) was not performed.

Comparative Example 2

The procedure for preparation of the toner in Example 1 was repeated except that the weight ratio ((2)/MT) of the fluorine-containing compound (2) to the mother toner (MT) was 0.02/100.

Comparative Example 3

The procedure for preparation of the toner in Example 1 was repeated except that the weight ratio ((2)/MT),of the fluorine-containing compound (2) to the mother toner (MT) was 0.7/100.

Seven (7) parts of each of the thus prepared toners of Examples 1 to 7 and Comparative Examples 1 to 3 was mixed with 100 parts of a carrier using a TURBULA MIXER. The carrier was prepared as follows.

| Core material | |
|---|---|
| Mn-ferrite (weight average particle diameter of 35 μm) | 5,000 parts |
| Coating liquid | |
| Toluene | 450 parts |
| Silicone resin (SR2400 from Dow Corning Toray Silicone Co., Ltd., solid content of 50%) | 450 parts |
| Aminosilane (SH6020 from Dow Corning Toray Silicone Co., Ltd.) | 10 parts |
| Carbon black | 10 parts |

The components for the coating liquid were mixed for 10 minutes using a stirrer.

Then the core material and the coating liquid were added to a coating device having a vessel, in which a rotation disc and agitating blade are provided to circle the core material. Thus, the core material was coated with the coating liquid. Then the core material was baked for 2 hours at 250° C. Thus, the carrier was prepared. The average thickness of the coating layer formed on the core material is 0.5 μm.

Thus, developers of the present invention and comparative developers were prepared.

The toners and the developers were evaluated as follows.

(1) Tensile Strength (TS)

The tensile strength of each toner was measured by the method mentioned above.

(2) Methanol Wettability (MEW)

The methanol wettability of each toner was measured by the method mentioned above.

(3) Particle Diameters (Dv and Dn)

The volume average particle diameter (Dv) and number average particle diameter (Dn) of the toners were measured using a particle diameter measuring instrument, COULTER COUNTER TAII from Beckman Coulter. The aperture was 100 μm.

(4) Average Circularity (E)

The average circularity (E) of the toners was determined using a flow-type particle image analyzer FPIA-1000 from Sysmex Corp. The specific measuring method is mentioned above.

(5) Form Factors (SF-1 and SF-2)

The form factors SF-1 and SF-2 were determined by analyzing a photograph of particles of a toner, which had been taken by a scanning electron microscope (FE-SEM S-4200, manufactured by Hitachi Ltd.), using an image analyzer (LUZEX AP manufactured by Nireco Corp.) and an interface. The specific measuring method is mentioned above.

(6) Fixability (FX)

Each developer was set in a color copier IMAGIO NEO 450 from Ricoh Co., Ltd. which had been modified so as to have a belt fixing device, and solid toner images having a weight of 1.0±0.05 mg/cm$^2$ were formed on sheets of a paper TYPE 6200 from Ricoh Co., Ltd., and sheets of a copy/print paper <135> from NBS Ricoh while changing the temperature of the fixing belt, to determine the maximum fixable temperature (Tmax) and the minimum fixable temperature (Tmin) of each toner.

The maximum fixable temperature (Tmax) is determined as follows.

1) the toner images fixed at different fixing temperatures are carefully observed to determine whether a hot offset problem occurs; and 2) the maximum fixable temperature (Tmax) is defined as a fixing temperature above which a hot offset phenomenon is observed in the fixed images.

The maximum fixable temperature (Tmax) is preferably not lower than 190° C.

The minimum fixable temperature (Tmin) is determined as follows.

1) the toner images fixed at different fixing temperatures are rubbed with a pad; and
2) the image densities of the images before and after the rubbing are measured to determine the fixing rate FR:

$$FR=\{(ID2)/(ID1)\}\times 100(\%)$$

wherein ID1 represents the image density before rubbing and ID2 represents the image density after rubbing.

The minimum fixable temperature is defined as a fixing temperature below which the fixed image has a fixing rate less than 70%.

The minimum fixable temperature (Tmin) is preferably not higher than 140° C.

(7) Cleanability (CL)

Each developer was set in an image forming apparatus, IPSIO COLOR 8100 manufactured by Ricoh Co., Ltd., which had been modified so as to have an oil-less fixing device, and 100 copies were produced. The toner particles remaining on the photoreceptor even after a cleaning operation were transferred using an adhesive tape, SCOTCH TAPE from Sumitomo 3M Ltd. The tape was set on a white paper to determine the difference in density between a blank adhesive tape and the adhesive tape with the toner particles. The density was measured by a reflection densitometer X-RITE 938 manufactured by X-Rite. Cleanability is graded as follows.

◎: Difference in density is less than 0.005.

○: Difference in density is from 0.005 to 0.10.

Δ: Difference in density is from 0.011 to 0.02.

X: Difference in density is greater than 0.02.

(8) Charge Stability (CS)

Each developer was set in an image forming apparatus, IPSIO COLOR 8100 manufactured by Ricoh Co., Ltd., which had been modified so as to have an oil-less fixing device, and a running test in which 100,000 copies of an original image with an image area proportion of 5% are continuously produced was performed. The charge quantities of each developer were measured before and after the running test to determine change of charge quantity.

The charge quantity of a developer was determined by subjecting 1 gram of the developer to a blow-off treatment. The charge stability is graded as follows.

○: Change of charge quantity is not greater than 5 μc/g.

Δ: Change of charge quantity is not greater than 10 μc/g.

X: Change of charge quantity is greater than 10 μc/g.

(9) Image Density (ID)

Each developer was set in a color copier IMAGIO NEO 450 from Ricoh Co., Ltd. which had been modified so as to have a belt fixing device, and a solid toner image having a weight of 0.4±0.1 mg/cm$^2$ was formed on a receiving paper TYPE 6200 from Ricoh Co., Ltd. The image density of the image was measured with a densitometer X-RITE 938 from X-Rite. The image density was graded as follows.

○: Image density is not lower than 1.4.

X: Image density is lower than 1.4.

(10) Granularity and Sharpness of Image (G+S)

Each developer was set in an image forming apparatus, IPSIO COLOR 8100 manufactured by Ricoh Co., Ltd., which had been modified so as to have an oil-less fixing device, and monochrome images of a photograph image were produced. The images were visually observed to evaluate the image qualities (i.e., granularity and sharpness) of the images. The granularity and sharpness are graded as follows.

◎: Image qualities are almost the same as those of images produced by offset printing.

○: Image qualities are slightly worse than those of images produced by offset printing.

Δ: Image qualities are worse than those of images produced by offset printing, but are better than those of images produced by conventional electrophotographic image forming apparatus.

X: Image qualities are the same as those of images produced by conventional electrophotographic image forming apparatus.

(11) Background Development (BD)

Each developer was set in an image forming apparatus, IPSIO COLOR 8100 manufactured by Ricoh Co., Ltd., which had been modified so as to have an oil-less fixing device, and a running test in which 100,000 copies of an original image with an image area proportion of 5% are continuously produced was performed. The 100,000th image was visually observed using a loupe to determine whether the background area of the image was soiled with toner particles. The background development was graded as follows.

◎: The background area is not soiled with toner particles.

○: The background area is slightly soiled with toner particles but it causes no problem.

Δ: The background area is soiled a little with toner particles.

X: The background area is seriously soiled with toner particles.

(12) Toner Scattering (TS)

Each developer was set in an image forming apparatus, IPSIO COLOR 8100 manufactured by Ricoh Co., Ltd., which had been modified so as to have an oil-less fixing device, and a running test in which 100,000 copies of an original image with an image area proportion of 5% are continuously produced was performed under an environmental condition of 40° C. in temperature and 90% in relative humidity. Then the inside of the image forming apparatus was visually observed to determine whether the inside of the image forming apparatus is contaminated with scattered toner particles. The toner scattering is evaluated as follows.

◎: The inside of the image forming apparatus is not contaminated with toner particles.

○: The inside of the image forming apparatus is slightly contaminated with toner particles but it causes no problem.

Δ: The inside of the image forming apparatus is contaminated a little with toner particles.

X: The inside of the image forming apparatus is seriously contaminated with toner particles.

(13) Environmental Stability (ST)

Ten grams of each toner was contained in a glass container having a volume of 20 ml. After the glass container was then tapped 100 times, the container was allowed to settle for 24 hours in a chamber in which the temperature and humidity are controlled so as to be 55° C. and 80% RH. Then the penetration of the toner in the container was measured. The procedure for the evaluation repeated except that the environmental condition was changed to 10° C. and 15% RH. The environmental stability is evaluated by grading the penetration into the following four ranks.

◎: The penetration is not less than 20 mm.

○: The penetration is not less than 15 mm and less than 20 mm.

Δ: The penetration is not less than 10 mm and less than 15 mm.

X: The penetration is less than 10 mm.

(14) Transferability (TR)

Each developer was set in an image forming apparatus, which was modified so as to have an oil-less fixing device. The developing device was activated for 60 minutes while no image was output, to apply a stress to the toner therein. Then a toner image having a weight of 0.4 mg/cm$^2$ was formed on the photoreceptor, and the toner image was transferred to a receiving paper (TYPE 6200 from Ricoh Co., Ltd.) at a transfer current of 15 μA. Then the toner particles remaining on the surface of the photoreceptor were transferred to an adhesive tape, SCOTCH TAPE from Sumitomo 3M Ltd. The tape was set on a white paper to determine the difference in density between a blank adhesive tape and the adhesive tape with toner particles. The density was measured by a reflection densitometer X-RITE 938 manufactured by X-Rite. Transferability is graded as follows.

◎: Difference in density is less than 0.005.

○: Difference in density is from 0.005 to 0.015.

Δ: Difference in density is from 0.016 to 0.02.

X: Difference in density is greater than 0.02.

(15) Evenness of Image (EN)

Each developer was set in an image forming apparatus, which had been modified so as to have an oil-less fixing-device. The developing device was activated for 60 minutes while no image was output, to apply a stress to the toner therein. Then a toner image having a weight of 0.4 mg/cm$^2$ was formed on the photoreceptor, and the toner image was transferred to a receiving paper (TYPE 6200 from Ricoh Co., Ltd.) at a transfer current of 15 μA. Then the toner particles remaining on the surface of the photoreceptor were transferred to an adhesive tape, SCOTCH TAPE from Sumitomo 3M Ltd. The tape was set on a white paper to visually observe the residual toner image. The unevenness of the toner images was graded as follows.

◎: The toner image is even.

○: The toner image is slightly uneven but the image causes no problem.

Δ: The toner image has a little unevenness.

X: The toner image is seriously uneven.

(16) F/C Ratio

The ratio (F/C) of fluorine atom to carbon atom at the surface of the toner was determined by subjecting the toner to X-ray photoelectron spectroscopy (XPS). The measuring method is mentioned above.

TABLE 1

| | TS | MEW | Circularity | | | Particle diameter | | |
|---|---|---|---|---|---|---|---|---|
| | (Pa) | (Vol %) | E | SF-1 | SF-2 | Dv(μm) | Dn(μm) | Dv/Dn |
| Ex. 1 | 3140 | 42 | 0.96 | 120 | 115 | 5.5 | 5.1 | 1.08 |
| Ex. 2 | 6280 | 51 | 0.96 | 120 | 115 | 5.5 | 5.1 | 1.08 |
| Ex. 3 | 2512 | 63 | 0.96 | 120 | 115 | 5.5 | 5.1 | 1.08 |
| Ex. 4 | 1884 | 50 | 0.96 | 120 | 115 | 5.5 | 5.1 | 1.08 |
| Ex. 5 | 8164 | 54 | 0.89 | 115 | 128 | 7.0 | 5.7 | 1.23 |
| Ex. 6 | 9420 | 26 | 0.86 | 149 | 141 | 7.1 | 5.6 | 1.27 |
| Ex. 7 | 8792 | 31 | 0.85 | 148 | 142 | 4.3 | 3.7 | 1.16 |
| Comp. Ex. 1 | 11932 | 19 | 0.96 | 120 | 115 | 5.6 | 5.1 | 1.10 |
| Comp. Ex. 2 | 10676 | 26 | 0.96 | 120 | 115 | 5.6 | 5.1 | 1.10 |
| Comp. Ex. 3 | 890 | 70 | 0.97 | 121 | 117 | 5.6 | 5.0 | 1.12 |

TABLE 2

| | F/C | Fixability | | CL | CS | ID |
|---|---|---|---|---|---|---|
| | | Tmax(° C.) | Tmin(° C.) | | | |
| Ex. 1 | 0.051 | 135 | ≧210 | ○ | ○ | ○ |
| Ex. 2 | 0.012 | 140 | ≧210 | ○ | Δ | ○ |
| Ex. 3 | 0.034 | 140 | 200 | ○ | ○ | ◎ |
| Ex. 4 | 0.054 | 140 | ≧210 | ◎ | ◎ | ◎ |
| Ex. 5 | 0.048 | 150 | 190 | ○ | ○ | ○ |
| Ex. 6 | 0.037 | 150 | 200 | ◎ | ○ | ○ |
| Ex. 7 | 0.043 | 155 | ≧210 | ○ | ○ | ○ |
| Comp. Ex. 1 | 0.000 | 140 | ≧210 | ○ | X | ○ |
| Comp. Ex. 2 | 0.008 | 135 | ≧210 | ○ | X | ○ |
| Comp. Ex. 3 | 0.128 | 165 | 170 | X | ○ | X |

TABLE 3

| | G + S | BD | TS | ST | TR | EN |
|---|---|---|---|---|---|---|
| Ex. 1 | ○ | ○ | ○ | ○ | ○ | ○ |
| Ex. 2 | ○ | Δ | Δ | ◎ | Δ | Δ |
| Ex. 3 | ○ | Δ | ○ | ○ | ◎ | ○ |
| Ex. 4 | ○ | ○ | ◎ | ○ | ○ | ◎ |
| Ex. 5 | ○ | Δ | Δ | ○ | ○ | ○ |
| Ex. 6 | Δ | ○ | ○ | ◎ | Δ | ○ |
| Ex. 7 | Δ | ○ | ◎ | ◎ | Δ | ○ |
| Comp. Ex. 1 | X | X | X | ○ | X | X |
| Comp. Ex. 2 | X | X | X | ○ | X | X |
| Comp. Ex. 3 | ○ | X | X | ○ | ○ | X |

It is clear from Tables 1 to 3 that the toners of Examples 1 to 7, which have a tensile strength (TS) of from 900 to 10,000 Pa and a methanol wettability (MEW) of from 25 to 65% by volume, have a good combination of developability, transferability, fixability, cleanability and environmental. In contrast, the comparative toners of Comparative Examples 1 to 3, which do not satisfy at least one of the tensile strength (TS) and the methanol wettability (MEW), do not have a good combination of developability, transferability, fixability, cleanability and environmental stability.

Among the toner of the present invention, the toners of Examples 1 to 4, which have a circularity of from 0.90 to 0.99 and a ratio (Dv/Dn) not greater than 1.15, are superior to the toners of Examples 5 to 7, which do not satisfy the conditions, in image density, granularity and sharpness of image.

This document claims priority and contains subject matter related to Japanese Patent Application No. 2004-223939, filed on Jul. 30, 2004, incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A toner comprising:

a binder resin;

a colorant, and a fluorine-containing compound, wherein an atomic ratio (F/C) of a fluorine atom to a carbon atom at a surface of the toner is from 0.010 to 0.110, wherein the fluorine-containing compound adheres to the binder resin or an ion of the fluorine-containing compound bonds with the binder resin, and the ion contains the fluorine atom wherein a pellet of the toner which is prepared by applying a pressure of 15 kg/cm$^2$ to the toner has a tensile strength of from 900 Pa to 10,000 Pa, and wherein the toner has a methanol wettability of from 25 to 65% by volume, wherein the methanol wettability is measured by a method in which (1) 0.5 g of the toner is dispersed in a mixture solvent of 42 ml of pure water and 18 ml of methanol; (2) the mixture is subjected to a dispersion treatment for 5 minutes using an ultrasonic dispersion machine to prepare a toner dispersion; and (3) methanol is added to the toner dispersion while checking a transparency of a mixture of methanol and the toner dispersion to determine a transparency dropping point of the toner dispersion, wherein the methanol wettability (MEW) is defined by the following equation:

$$MEW(\%\text{ by volume})=\{Vm/(Vm+Vw)\}\times 100,$$

wherein Vm represents a total volume (ml) of methanol in the mixture at the transparency dropping point, and Vw represents the total volume of pure water in the mixture.

2. The toner according to claim 1, wherein the binder resin comprises a polyester resin.

3. The toner according to claim 2, wherein the polyester resin comprises a modified polyester resin.

4. The toner according to claim 3, wherein the polyester resin further comprises an unmodified polyester resin, and wherein a weight ratio of the modified polyester resin to the unmodified polyester resin is from 5/95 to 80/20.

5. The toner according to claim 1, wherein the fluorine-containing compound is an ion having the following formula (I):

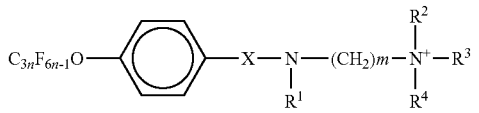

(I)

wherein X represents $SO_2$— or CO—; each of $R^1$, $R^2$, $R^3$ and $R^4$ represents a hydrogen atom, an alkyl group having from 1 to 10 carbon atoms, or an aryl group having from 6 to 18 carbon atoms; and each of m and n is a positive integer.

6. The toner according to claim 1, wherein the fluorine-containing compound is bonded with the polyester resin.

7. The toner according to claim 1, wherein the toner is prepared by a method including the following steps:

reacting a toner composition comprising a polyester prepolymer with a crosslinking agent and/or a polymer chain extension agent in an aqueous medium to prepare a dispersion comprising a polyester resin; and adding the fluorine-containing compound to the dispersion to adhere the fluorine-containing compound to the polyester resin or to bond an ion of the fluorine-containing compound with the polyester resin, wherein the ion contains a fluorine atom.

8. The toner according to claim 1, further comprising a first hydrophobized particulate inorganic material having a primary particle diameter of from 30 to 150 nm, wherein the first hydrophobized particulate inorganic material is present at least on a surface of particles of the toner.

9. The toner according to claim 8, further comprising a second hydrophobized particulate inorganic material having a primary particle diameter of from 1 to 20 nm, wherein the second hydrophobized particulate inorganic material is present at least on the surface of particles of the toner.

10. The toner according to claim 1, wherein the toner has a circularity of from 0.90 to 0.99.

11. The toner according to claim 1, wherein the toner has a first form factor SF-1 of from 103 to 150, and a second form factor SF-2 of from 101 to 140.

12. The toner according to claim 1, wherein the toner has a volume average particle diameter of from 2 to 7 μm.

13. The toner according to claim 1, wherein the toner has a ratio (Dv/Dn) of a volume average particle diameter (Dv) to a number average particle diameter (Dn) not greater than 1.15.

14. A developer comprising the toner according to claim 1 and a carrier.

15. An image forming apparatus comprising:

an image bearing member configured to bear an electrostatic latent image thereon;

a developing device configured to develop the electrostatic latent image with a developer comprising the toner according to claim 1 to form a toner image on the image bearing member; and a transferring device configured to transfer the toner image onto a receiving material optionally via an intermediate transfer medium.

16. The image forming apparatus according to claim 15, wherein the image bearing member is a photoreceptor comprising amorphous silicon.

17. The image forming apparatus according to claim 15, further comprising a contact charging device configured to charge the image bearing member while contacting the image bearing member.

18. The image forming apparatus according to claim 17, further comprising:

a fixing device configured to fix the toner image on the receiving material, wherein the fixing device comprises:

a heating member comprising a heater;

a film which contacts the heating member and which is configured to heat the receiving material having the toner image thereon while contacting the image; and a pressing member configured to press the film toward the hearing member, wherein the receiving material bearing the toner image thereon is passed through a nip between the film and the pressing member.

19. A process cartridge comprising:

an image bearing member configured to bear an electrostatic latent image; and a developing device configured to develop the latent image with a developer comprising the toner according to claim 1.

20. An image forming method comprising:

forming an electrostatic latent image on an image bearing member;

developing the electrostatic latent image with a developer including the toner according to claim 1 to prepare a toner image;

transferring the toner image onto a receiving material optionally via an intermediate transfer medium.

* * * * *